US009372001B2

(12) United States Patent
Gayle et al.

(10) Patent No.: US 9,372,001 B2
(45) Date of Patent: Jun. 21, 2016

(54) HOME COOKING APPLIANCE WITH A SIDE SWING OVEN DOOR HAVING AN INTEGRAL SELF CAPTURING LATCH

(71) Applicant: BSH Home Appliances Corporation, Irvine, CA (US)

(72) Inventors: James Gayle, New Bern, NC (US); Joseph Geiger, Trent Woods, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 174 days.

(21) Appl. No.: 14/019,618

(22) Filed: Sep. 6, 2013

(65) Prior Publication Data

US 2015/0068509 A1 Mar. 12, 2015

(51) Int. Cl.
*E05B 63/20* (2006.01)
*F24C 15/02* (2006.01)
(Continued)

(52) U.S. Cl.
CPC ..... *F24C 15/022* (2013.01); *E05B 17/0025* (2013.01); *E05C 19/04* (2013.01); *E05B 15/0006* (2013.01); *E05B 2063/0026* (2013.01)

(58) Field of Classification Search
CPC ..... F24C 15/02; F24C 15/022; F24C 15/023; E05C 19/02; E05C 19/024; E05C 19/04; E05C 19/06; E05C 19/063; E05B 17/0025; E05B 15/0006; E05B 2063/0026
USPC ..... 292/63–65, 69, 95, 109–111, 121, 122, 292/124, 129, 96, 98, 99, 240, 195, 219, 292/220, 222, 224, 229, 197, 198, 341.15, 292/341.17, 341.18, 341.19, 332, 334, 336, 292/DIG. 49, DIG. 55, DIG. 69, DIG. 71, 78, 292/79, 73; 126/190, 197, 192, 220, 273 R, 126/1 R, 42, 39 BA
See application file for complete search history.

(56) References Cited

U.S. PATENT DOCUMENTS 2,677,566 A * 5/1954 Burke ..... 292/332
2,679,423 A * 5/1954 Anderson et al. ..... 292/332
(Continued)

FOREIGN PATENT DOCUMENTS

DE 2826712 A1 * 12/1979 ..... A47L 15/4259
FR DE 2156170 A1 * 5/1972 ..... E05B 65/0042

OTHER PUBLICATIONS

Computer Generated Translation for DE 2156170, http://worldwide.espacenet.com, translated on Nov. 23, 2015.*

*Primary Examiner* — Alyson M Merlino
(74) *Attorney, Agent, or Firm* — James E. Howard; Andre Pallapies

(57) ABSTRACT

A home cooking appliance with a side swing door is provided. The home cooking appliance includes a self capturing latch mechanism that secures and seals the side swing door in the closed position, the self capturing latch mechanism including a stationary hook and a receiver that receives and draws part of the stationary hook into a secured position within the receiver when the side swing door is moved into the closed position to secure the side swing door in the closed position. The receiver provides a variable closing force that varies from a first closing force at an initial engagement of the receiver with the part of the stationary hook to a predetermined second closing force, which is greater than the first closing force, at a completed engagement of the receiver with the part of the stationary hook to seal the side swing door in the closed position.

23 Claims, 18 Drawing Sheets

(51) Int. Cl.

| | |
|---|---|
| ***E05C 19/04*** | (2006.01) |
| ***E05B 17/00*** | (2006.01) |
| *E05B 15/02* | (2006.01) |
| *E05B 15/00* | (2006.01) |
| *E05B 63/00* | (2006.01) |

(56) References Cited

U.S. PATENT DOCUMENTS

| | | | | | |
|---|---|---|---|---|---|
| 2,679,426 | A | * | 5/1954 | Bauder | 292/332 |
| 2,681,819 | A | * | 6/1954 | Burke | 292/226 |
| 2,741,505 | A | * | 4/1956 | Clark | 292/341.17 |
| 2,764,874 | A | * | 10/1956 | Sharpe | 62/161 |
| 2,777,722 | A | * | 1/1957 | Burke | 292/332 |
| 2,779,618 | A | * | 1/1957 | Jewell | 292/332 |
| 2,790,666 | A | * | 4/1957 | Vanderveld | 292/341.17 |
| 3,045,465 | A | * | 7/1962 | Larson | 70/153 |
| 4,960,297 | A | * | 10/1990 | Bouse et al. | 292/223 |
| 5,437,173 | A | * | 8/1995 | Spinar | 70/89 |
| 5,746,456 | A | | 5/1998 | Violi et al. | |
| 5,937,481 | A | | 8/1999 | Faringosi | |
| 2009/0178663 | A1 | * | 7/2009 | Filippi | 126/192 |
| 2010/0281650 | A1 | | 11/2010 | Kleemann et al. | |
| 2012/0067333 | A1 | | 3/2012 | Mirshekari et al. | |

* cited by examiner

HOME COOKING APPLIANCE WITH A SIDE SWING OVEN DOOR HAVING AN INTEGRAL SELF CAPTURING LATCH

FIELD OF THE INVENTION

The present invention is directed to a home cooking appliance, and more particularly, to a home cooking appliance with a side swing door having an integral self capturing latch.

BACKGROUND OF THE INVENTION

A home cooking appliance, such as a freestanding oven or built-in oven, commonly includes a door coupled to the appliance housing by two or more hinges such that the door can move between a closed position for sealing items to be cooked within the cooking cavity and an open position for placing items to be cooked into the cooking cavity or removing items from the cooking cavity.

One type of home cooking appliance commonly includes a door that swings vertically about the hinges such that, when the oven door is in the open position, the door extends horizontally outward from a lower end of the oven in front of the cooking cavity. Since the door swings vertically and outward over the lower part of the oven, the door in this conventional arrangement is not at risk of interfering with adjacent cabinetry or appliances. As a result, a variety of types and sizes of hinges can be used to provide a necessary amount of closing force on the door to maintain the door in the closed position and provide a suitable seal of the door seal around the opening of the cooking cavity without interfering with adjacent cabinetry or appliances.

Another type of home cooking appliance may include a side swing door that swings laterally about the hinges such that, when the oven door is in the open position, the door extends vertically outward from one side of the oven such that the door is positioned to the side of the cooking cavity. A side swing door may provide greater access to the cooking cavity from directly in front of the appliance, which may be helpful for placing large or heavy items into the cooking cavity or removing such large or heavy items from the cooking cavity. With a side swing door, a user also does not need to reach over the hot surface of the interior side of the oven door to place items into the cooking cavity or to remove items from the cooking cavity. However, since the door swings laterally away from the cooking cavity and is positioned alongside the cooking cavity when the door is in an open position, the operation of the door may be affected by, or interfered with by, adjacent cabinetry or appliances, or the door may interfere with the operation of one or more doors of such adjacent cabinetry or appliances. In addition, the door commonly is configured to be flush with any adjacent cabinetry or appliances. Due to the limited space available on the appliance housing, the conventional means for securing a vertical swing door to the appliance are not suitable for a side swing door and only a limited amount of different types of hinges can be used to secure the door without the door interfering with adjacent cabinetry or appliance.

Additionally, because of the limitations on the size and types of suitable hinges that can be used with a home cooking appliance having a side swing door, as well as various space limitations associated with such side swing doors, conventional home cooking appliances ordinarily must have an external part to keep the side swing door closed.

SUMMARY OF THE INVENTION

The present invention, as illustrated for example in the exemplary embodiments, provides a home cooking appliance a housing having a cooking cavity, a side swing door movable between a closed position and an open position to provide access to the cooking cavity, and a self capturing latch mechanism that secures and seals the side swing door in the closed position, the self capturing latch mechanism including a stationary hook, and a receiver that receives and draws a part of the stationary hook into a secured position within the receiver when the side swing door is moved into the closed position to secure the side swing door in the closed position, the stationary hook and the receiver being mounted on opposing surfaces of the housing and the side swing door that face each other when the side swing door is in the closed position, and the receiver providing a variable closing force that varies from a first closing force at an initial engagement of the receiver with the part of the stationary hook to a predetermined second closing force, which is greater than the first closing force, at a completed engagement of the receiver with the part of the stationary hook to seal the side swing door in the closed position.

More particularly, in an exemplary embodiment, the self capturing latch mechanism can include a stationary hook and a receiver that receives the stationary hook when the side swing door is moved into the closed position and secures the side swing door in the closed position, the stationary hook and the receiver being mounted on opposing surfaces of the housing and a surface of the side swing door that faces the housing when the side swing door is in the closed position. The receiver can include a spring loaded latching mechanism actuated by contact with the part of the stationary hook received in the receiver, wherein the actuated spring loaded latching mechanism draws the part of the stationary hook into the receiver with a force that increases from a first predetermined closing force, which is capable of drawing the part of the stationary hook into the receiver, to a predetermined second closing force, which is capable of maintaining the side swing door in the closed position in a sealed state.

In this way, the present invention provides a home cooking appliance with a side swing door having an integral self capturing latch that is capable of providing a predetermined closing force, such as a ten (10) pound closing force, to provide a secure and sufficient seal of the door with the oven cavity while also providing a latch which quickly releases that force in response to a short pull stroke. The latch also can be configured to require a very low push force on the door to trigger the latch to pull the door in and hold the door securely in the closed position. In other words, the exemplary embodiments of the cooking appliance door can provide a very secure seal while simultaneously permitting a very low release/engagement force from a user in order to operate the door latch. The exemplary embodiments also can provide a desirable tactile perception to the user, thereby providing a desired "touch and feel" to the operation of the door of the appliance. Moreover, the present invention provides a home cooking appliance with a side swing door having an integral self capturing latch that self aligns the door with the oven chassis and self corrects for a sagging condition of the door.

For further clarification and background of the present invention, various aspects and considerations of a home cooking appliance having a side swing door, which have been recognized by the present invention, will now be described. As explained above, with a side swing door, the door swings laterally away from the cooking cavity and is positioned alongside the cooking cavity when the door is in an open position. In addition, the door commonly is configured to be flush with any adjacent cabinetry or appliances. As a result, the door must be configured such that the operation of the door is not affected by, or interfered with by, adjacent cabinetry or appliances, and such that the door does not interfere with the operation of one or more doors of such adjacent cabinetry or appliances. Due to the limited space available on the appliance housing, the conventional means for securing a vertical swing door to the appliance are not suitable for a side swing door and only a limited amount of different types of hinges can be used to secure the door without the door interfering with adjacent cabinetry or appliance. The present invention recognizes that, for example, because of the limitations on space and the limitations on types of suitable hinges that can be used, the home cooking appliance must include a catch or latch mechanism to secure and hold the side swing door in the closed position and to maintain a suitable amount of pressure on the oven door seal in order to provide a safe and robust side swing door for a home cooking appliance.

A variety of conventional latch designs and assemblies exist for latching various types of doors to various types of housings. However, none of the conventional latch designs or assemblies is capable of providing the necessary closing force, tactile feel, and other functional requirements of the present invention in view of the recognized limitations on space and operation of a side swing door of a home cooking appliance. For example, a design of a conventional car door style latch or the like requires a button or movable handle to release the latch mechanism, which is not desirable or suitable for a side swing oven door. Additionally, these conventional latch designs are noisy and clunky, and fail to provide the desirable tactile perception to the user. As another example, a common cabinet door latch can secure the door without requiring a button or movable handle to release the latch. However, such common cabinet door latches only open and close with a fixed amount of force and are not capable of providing an initially higher amount of opening force that reduces to a lower amount of opening force, and then eventually disengaging the latch. The conventional latch assemblies also are not capable of providing a low closing force that increases to a predetermined amount of closing force needed (e.g., 10 lbs.) to properly seal a cooking appliance door against a seal of the appliance chassis. Additionally, these conventional cabinet latch designs are noisy and clunky, and fail to provide the desirable tactile perception to the user. The present invention recognizes that a unique and specialized latch mechanism design is needed to meet the unique combination of functional requirements of operation, force, and size limitations of a cooking appliance having a side swing door.

Additionally, the present invention recognizes that, unlike a vertical swing door, a side swing door is susceptible to sagging of the door over time, for example, due to the weight of the door on the hinges particularly when the door is in an opened position and/or due to a user leaning on or applying force on the door when the door is in an opened position. Over time, such sagging may interfere with the alignment of the door, and particularly, with the alignment of the catch or latch mechanism of the door, thereby resulting in misalignment of the catch or latch mechanism, which may reduce the effectiveness of the seal of the door against the chassis of the appliance, resulting in misalignment of the door, for example, with the chassis of the cooking appliance or with adjacent cabinetry or appliances, which may affect the aesthetic appearance of the appliance, resulting in a noisy or difficult latching operation, which may provide a tactile perception to the user of cheap or poorly designed product, or completely rendering the door inoperable.

The exemplary embodiments of the present invention solve these and other problems by providing, for example, a home cooking appliance with a side swing door having an integral self capturing latch comprising a spring loaded, latching, receiver mechanism mounted in the door to capture, pull, and latch onto a stationary "hook" integrated on the front of the oven chassis. One of ordinary skill in the art will recognize that other embodiments are possible in which the receiver mechanism can alternatively be provided in the front of the oven chassis and the stationary hook can be provided on the side swing oven door.

In an exemplary embodiment, the exemplary latch mechanism can be configured to apply a predetermined amount of closing force (e.g., 10 pounds of closing force) on the door seal to secure and hold the side swing door in the closed position and to maintain a suitable amount of pressure on the oven door seal in order to provide a safe and robust side swing door for a home cooking appliance.

Additionally, the exemplary embodiments of the invention can be configured to provide a desirable or acceptable amount of pull force (i.e., opening force) required to release the door from the closed, latched position. The exemplary embodiments of the invention can be configured to provide a desirable or acceptable amount of closing force required to secure and seal the door in the closed, latched position. More particularly, the exemplary embodiments of the invention can be configured such that very little closing force is required to secure and seal the door in the closed, latched position, thereby optimizing the touch and feel of the opening and closing operation of the door.

In an exemplary embodiment, the present invention can be configured to provide a predetermined amount of pull-in force necessary to provide sufficient pressure on the door seal, such as, for example, 10 lbs of pull-in force.

In an exemplary embodiment, the present invention can be configured such that, as the hook is removed from the receiver, the required pull force varies such that the pull force decreases throughout the opening operation of the door until the hook disengages from the receiver. More particularly, in an exemplary embodiment, the present invention can be specifically and intentionally configured such that, as the hook is removed from the receiver (i.e., as the door is pulled open by a user), the required pull force starts at for example 10 lbs, then decreases from 10 lbs to for example 3 lbs, and then disengages altogether to free the hook from the receiver. In this way, the present invention can improve the tactile perception to the user during the opening of the door.

In an exemplary embodiment, the present invention can be configured such that, as the hook is returned to and first engages the receiver, the hook is pulled into the receiver with limited or no effort by the user. More particularly, in an exemplary embodiment, the present invention can be specifically and intentionally configured such that, as the hook is returned to and first engages the receiver, the hook trips a mechanism that grabs the hook and pulls the hook the remaining distance into the receiver by reversing the pull force. In an embodiment, the pulling force can start at for example 3 lbs and end at for example 10 lbs of force. In this way, the exemplary embodiments of the present invention can require very little force to trip the mechanism upon closing the door, thereby improving the tactile perception to the user during the closing of the door.

In an exemplary embodiment, the present invention can be configured such that the latching mechanism can be easily and quickly reset if the latching mechanism is inadvertently tripped while the hook is disengaged from the receiver. For example, if a user inadvertently bumps or hits the receiver and causes the latching mechanism to move from a position where the hook is intended to be disengaged from the receiver to a position in which the hook is intended to be engaged in the receiver, the present invention provides means for quickly and easily resetting the latching mechanism of the receiver such that the hook can be easily engaged in the receiver. For example, in an exemplary embodiment, the user can simply bring the door closed and apply pressure until an audible or tactile click is heard or perceived by the user, thereby signaling to the user that the latching mechanism has been reset. In this case, the receiver is ready to receive and engage the hook, and in an exemplary embodiment, will have already engaged the hook in a secure and closed position. Next, as an additional or alternative step, the user can at least partly open the door and then close the door again to be sure that the latching mechanism of the receiver has been reset and that the hook is received and secured properly in the receiver.

In an exemplary embodiment, a latch trip spring can be provided to enable the latching mechanism to be easily and quickly reset if the latching mechanism is inadvertently tripped while the hook is disengaged from the receiver. Additionally, the exemplary latch trip spring also can provide separate and/or additional advantages of absorbing sound, thereby reducing the noise associated with closing the door and improving the audible perception of the latch to the user.

In another exemplary embodiment, the present invention can provide a spring capture mechanism in the receiver that securely holds the door and prevents the door from bouncing open if the door is slammed into the closed position by the user.

The exemplary embodiments of the present invention can be configured such that the receiver fits within the limited available space inside the door frame. The exemplary embodiments of the present invention also can be configured such that the components of the latch can withstand elevated temperatures of, for example, 90-100° C.

In an exemplary embodiment, the present invention provides an oven door with a self-capturing latch that aligns the door with the oven chassis and self corrects for sag. As explained above, over time, the weight of the side swing oven door may cause the door to sag, and therefore, the door will eventually need adjustment. In an exemplary embodiment, the present invention provides an oven door having a receiver that engages the stationary hook on the oven chassis to automatically align the door and self correct for sag. More particularly, the receiver and hook can include corresponding re-alignment features, such as a fixed roller on the receiver and a tapered surface on a top surface of the end of the stationary hook, that cooperate to bring a sagging door back up to the proper position as the door is moved into the closed position. In operation, the tapered surface on the top surface of the end of the stationary hook can engage a lower surface of the fixed roller of the receiver as the hook is engaged into the receiver while the door is being closed. The tapered top surface of the hook and the lower surface of the fixed roller operate as a cam and follower such that the fixed roller follows the upper surface of the hook as the door is closed, which causes the door to move vertically upward as the fixed roller moves over the tapered surface of the hook, thereby properly aligning the door (and receiver) with the hook on the oven chassis when the hook is completely engaged in the receiver. The fixed roller and the tapered upper surface of the hook also cooperate to align the latching components of the receiver with the hook to ensure that the hook is securely engaged with the retainer. In this way, the exemplary embodiments can provide a robust re-alignment feature that is strong enough to handle the impact of a misaligned oven door, which may weigh 35 lb or more.

For purposes of this disclosure, a side swing door is defined as a door that swings laterally about the hinges such that, when the door is in the open position, the door extends vertically outward from one side of the oven such that the door is positioned to the side of the cooking cavity.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
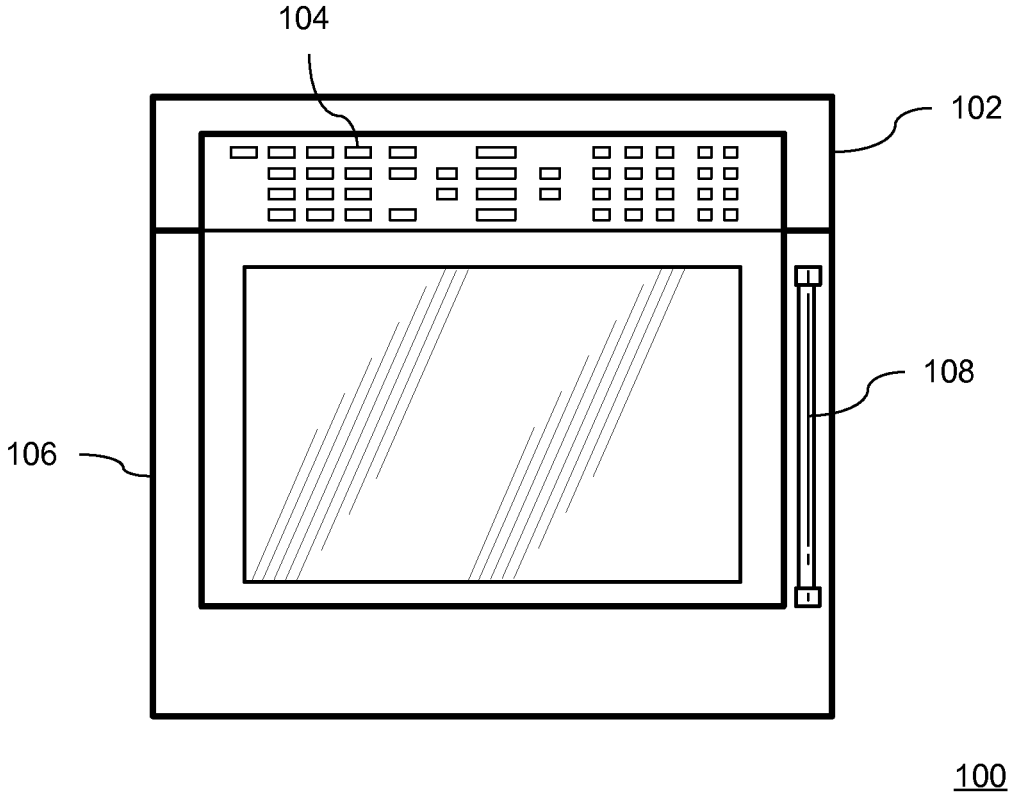
FIG. 1 is a front view of a home cooking appliance with a side swing door having an integral self capturing latch, in which the side swing door is closed, according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-9B illustrate exemplary embodiments of a home cooking appliance with a side swing door having an integral self capturing latch, according to exemplary embodiments of the invention. An exemplary home cooking appliance 100 will first be described with reference to FIGS. 1-4. Next, exemplary embodiments of a side swing door having an integral self capturing latch will be described with reference to FIGS. 5A-9B.

As shown in FIG. 1, a home cooking appliance 100, such as a built-in oven or freestanding oven, can include one or more cooking cavities (shown in FIG. 2) accessible via a door 106. The door 106 can be a side swing door, such as a right-hand opening door or a left-hand opening door. The home cooking appliance may include a control panel 102 having a plurality of controls 104 for controlling an operation of the appliance. The door 106 can include a handle 108.

Figure 2:
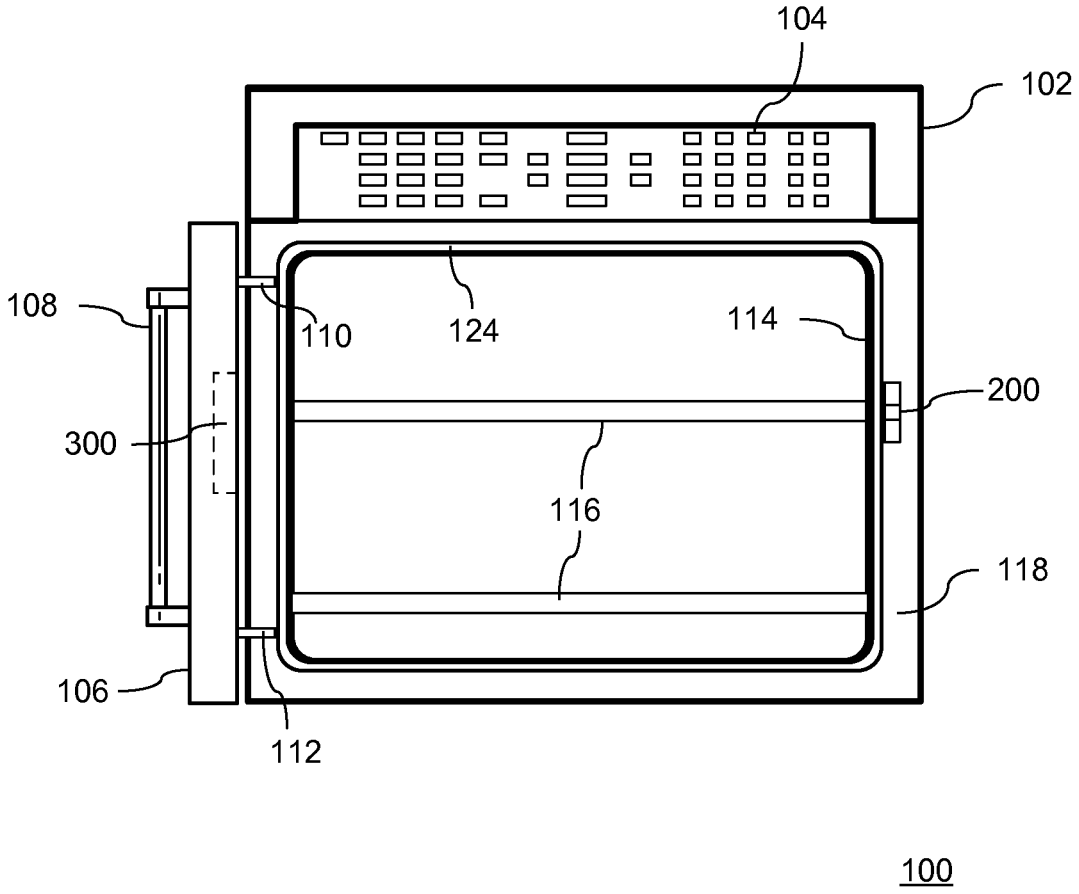
FIG. 2 is another front view of a home cooking appliance with a side swing door having an integral self capturing latch, in which the side swing door is open, according to an exemplary embodiment of the invention.

With reference to FIG. 2, the side swing door 106 can be movable about an upper hinge 110 and a lower hinge 112 between a closed position and an open position to provide access to a cooking cavity 114. The cooking cavity 114 can include one or more racks or shelves 116 for supporting items to be cooked. The front 118 of the appliance chassis or the inside of the door 106 can include means for sealing the door 106 to the chassis of the appliance 100, such as a temperature resistant seal 124. In the exemplary embodiment illustrated in FIG. 2, the cooking appliance 100 can include an integral self capturing latch having a stationary hook 200 mounted on the front 118 of the appliance chassis and a receiver 300 on the door 106 that receives the stationary hook 200 when the door 106 is moved into the closed position.

Figure 3:
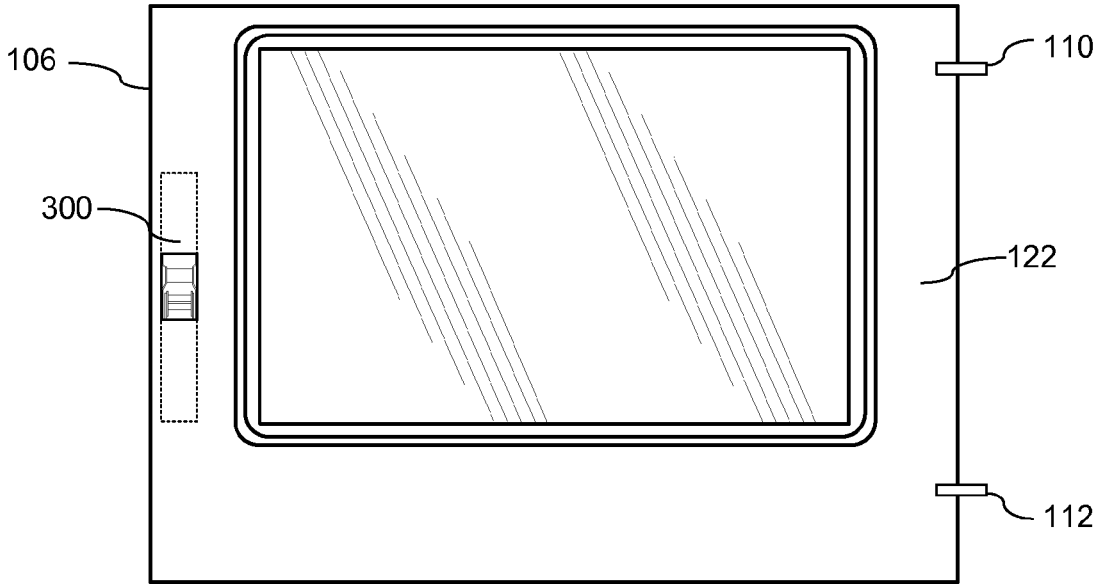
FIG. 3 is a plan view of a side swing door of a home cooking appliance with an integral self capturing latch, according to an exemplary embodiment of the invention.

With reference to FIG. 3, an example of an interior of a side swing door 106 can include an interior surface 122 having a receiver 300 that receives the stationary hook 200 of the appliance 100 when the door 106 is moved into the closed position. One of ordinary skill in the art will recognize that other embodiments are possible in which the receiver 300 can alternatively be provided in the front 118 of the oven chassis and the stationary hook 200 can be provided on the side swing oven door 106, for example, by inverting the position of the exemplary receiver 300 and hook 200.

Figure 4:
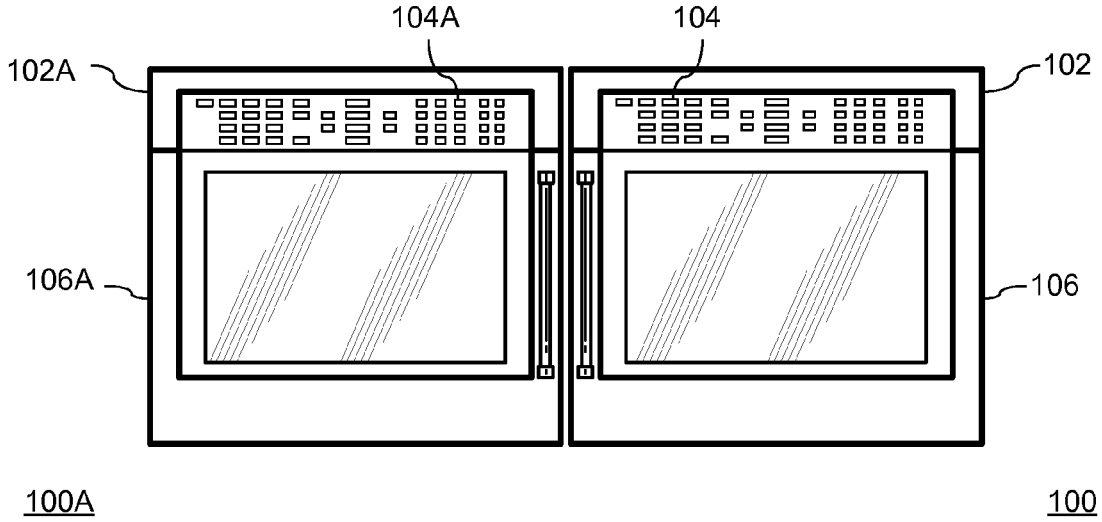
FIG. 4 is a front view of a pair of home cooking appliances with side swing doors having integral self capturing latches, in which the side swing doors are closed, according to an exemplary embodiment of the invention.

The exemplary embodiments are not limited to an appliance having any particular arrangement of door swing, such as a right-hand opening door or left-hand opening door. For example, as shown in FIG. 4, one or more appliances 100, 100A can be arranged alongside each other, or on top of each other. The doors 106, 106A of each of the appliances 100, 100A can open in the same direction or in opposite directions. The appliances 100, 100A can include control panels 102, 102A in the same position or in different positions. The controls 104, 104A of the control panel 102, 102A can be similar or identical, or have different arrangements. The doors 106, 106A each can include an integral self capturing latch having a stationary hook mounted on the front of the appliance chassis and a receiver on the door that receives the stationary hook when the door is moved into the closed position.

Figure 5A:
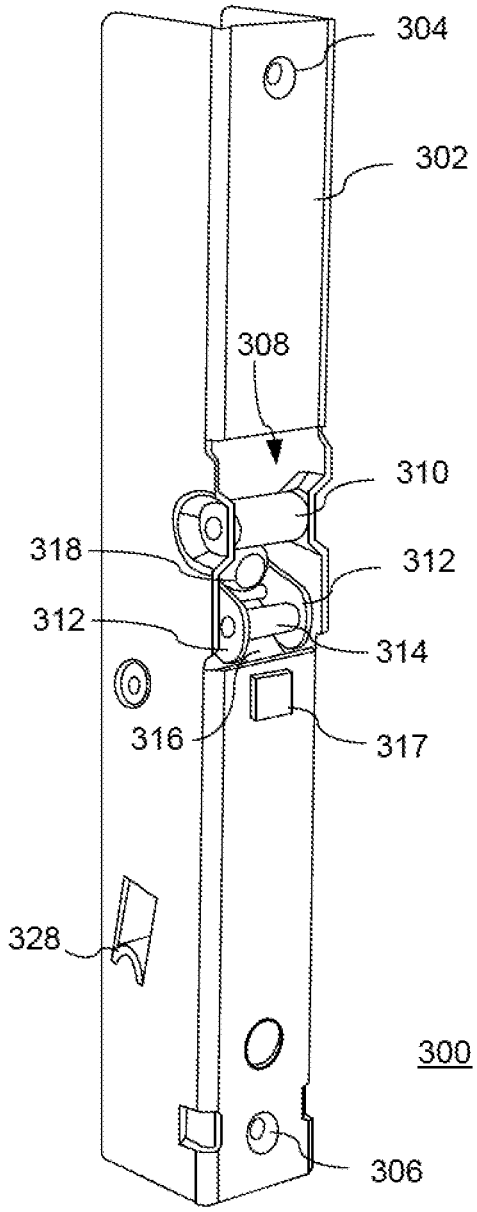
FIG. 5A is a perspective view of an integral self capturing latch of a side swing door of a home cooking appliance, according to an exemplary embodiment of the invention.
Figure 5B:
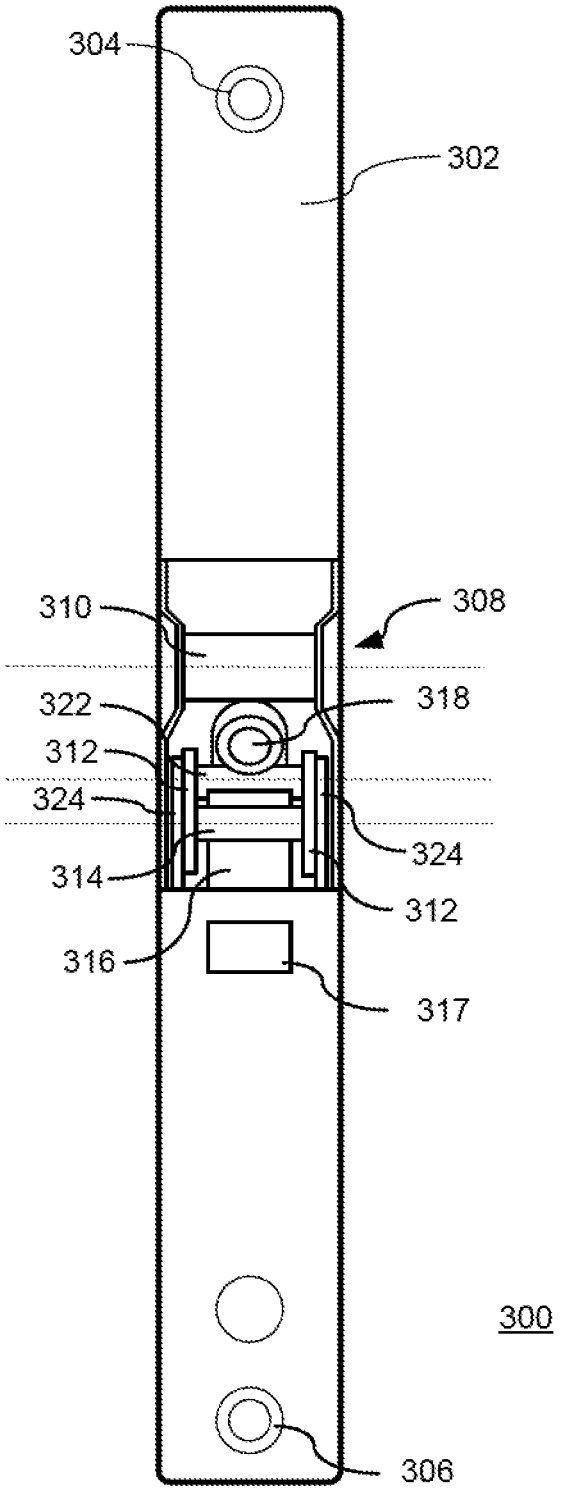
FIG. 5B is a front view of the integral self capturing latch according to the exemplary embodiment of the invention illustrated in FIG. 5A.
Figure 5C:
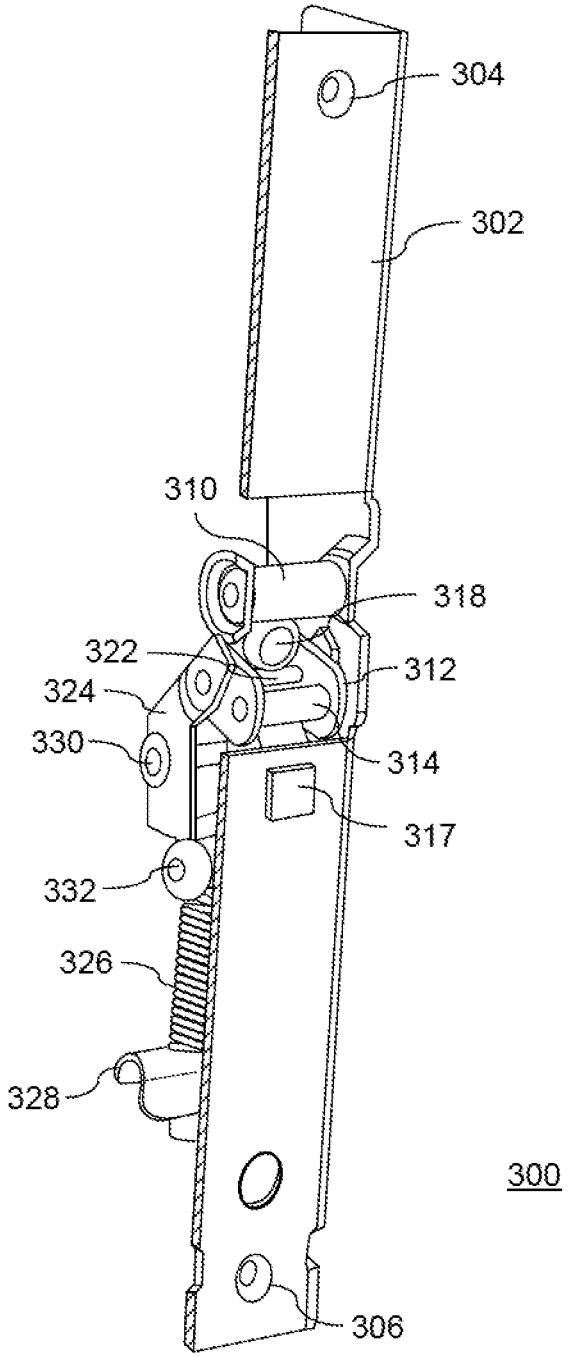
FIG. 5C is a perspective, cut-away view of the integral self capturing latch according to the exemplary embodiment of the invention illustrated in FIGS. 5A and 5B.
Figure 6A:
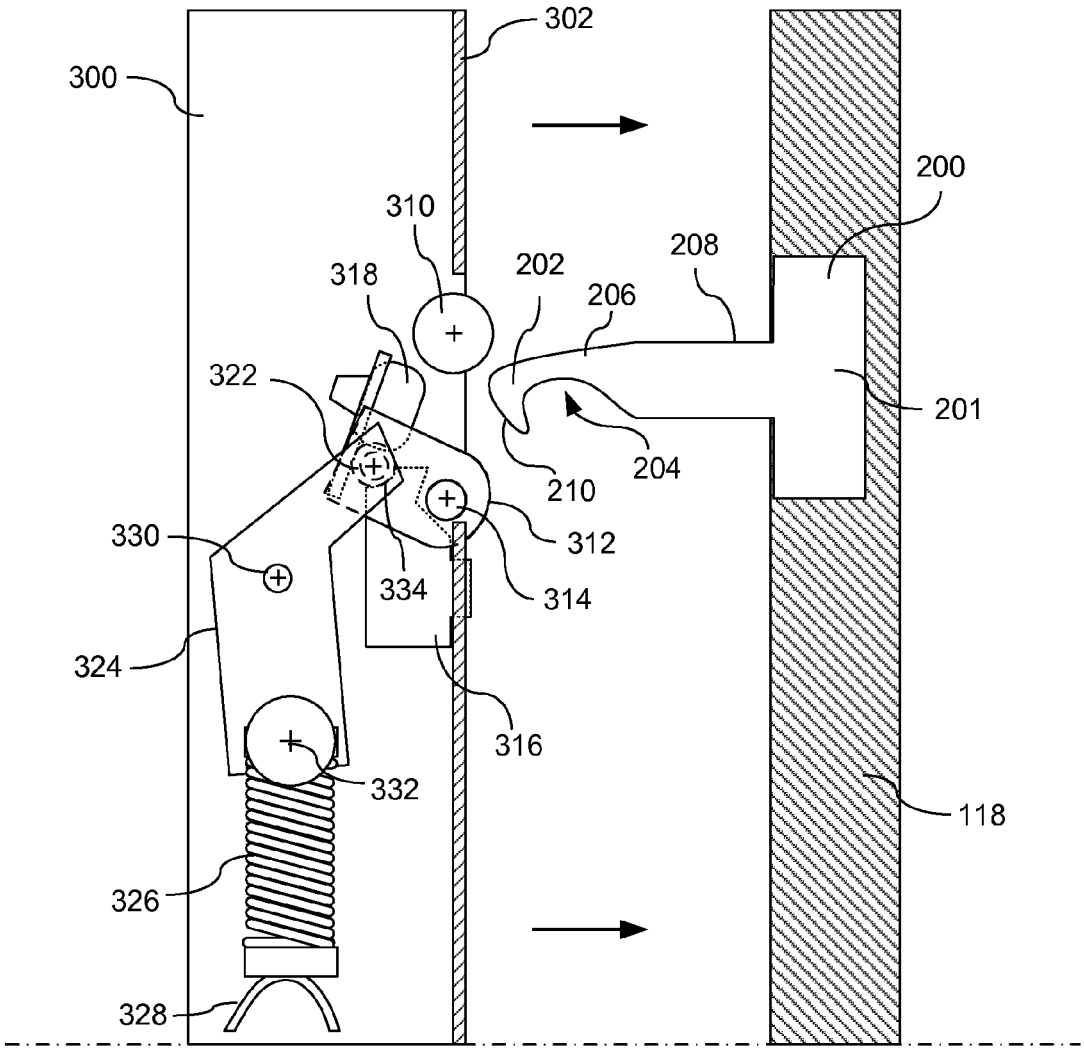
FIGS. 6A and 6B are partial side views schematically illustrating an operation of an integral self capturing latch of a side swing door of a home cooking appliance, according to an exemplary embodiment of the invention.
Figure 6B:
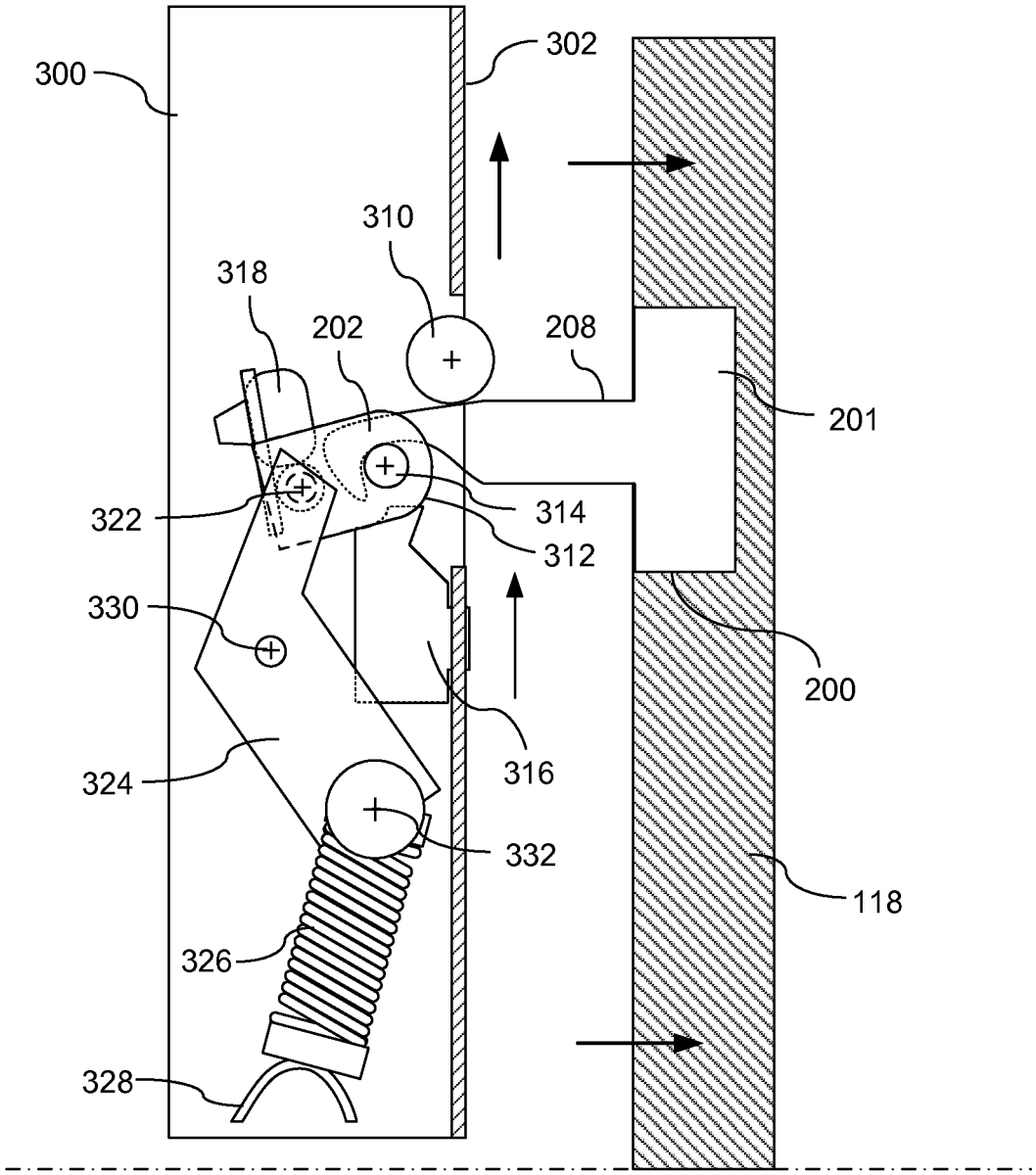

With reference to FIGS. 5A-5C, an exemplary embodiment of a receiver 300 will now be described. The exemplary receiver 300 can include a body with a front face 302 having one or more fastening means, such as openings 304, 306 for receiving fasteners, such as screws, for securing the latch 300 in position on the door 106. In other exemplary embodiments, the receiver 300 can be coupled to the door 106 in any suitable manner. The latch 300 can include an opening 308 in the front face 302 for receiving a stationary hook (e.g., 200 as shown in FIGS. 6A and 6B). A fixed roller 310 is disposed within, and accessible through, the opening 308. The roller 310 can be configured to rotate about an axis of the roller. However, in other embodiments, the roller 310 also can be fixed with respect to rotation. The roller 310 can be formed, for example, from a low friction or friction reducing material. As described in greater detail with reference to FIGS. 6A and 6B, the roller 310 cooperates with the stationary hook (e.g., 200 as shown in FIGS. 6A and 6B) to align the door 106 with the oven chassis and self correct for a sagging condition of the door 106.

With reference again to FIGS. 5A-5C, and also to FIGS. 6A-9B, exemplary embodiments of an integral self capturing latch for a side swing door of a home cooking appliance having will now be described.

As shown in FIGS. 5A-5C, an exemplary receiver 300 can include a hook roller carrier 312 having a hook roller 314 for engaging a part of the stationary hook (e.g., 200 as shown in FIGS. 6A and 6B). The hook roller carrier 312 can be pivotably mounted on a first pin 322. The hook roller 314 can be configured to rotate about an axis of the first pin 322. However, in other embodiments, the hook roller 314 can be fixed with respect to rotation. The hook roller 314 can be formed, for example, from a low friction or friction reducing material, particularly, for example, if the roller is fixed with respect to rotation.

The hook roller 314 can be configured to be rotated toward and engaged or latched onto a hook roller latch 316 when the door 106 (see FIG. 2) is in an open position and the receiver 300 has not engaged the stationary hook (e.g., 200 as shown in FIGS. 6A and 6B). The operation of the hook roller latch 316 will be described in greater detail with reference to FIGS. 6A and 6B. The hook roller latch 316 can include a means for securing the hook roller latch 316 to the body of the receiver 300, such as a projection 318 that engages an opening in the front face 302 of the receiver 300. However, the hook roller latch 316 can be coupled to the receiver 300 in other suitable ways.

As shown in FIGS. 5A-5C, the exemplary receiver 300 can include a rocker arm 324 that can be pivotably mounted on a rocker arm pin 330 that is fixed, for example, with respect to the body of the receiver 300. A first end of the rocker arm 324 can be pivotably coupled to the hook roller carrier 312 by the first pin 322. A second end of the rocker arm 324 can be pivotably coupled to a spring/plunger mechanism 326 by a second pin 312. The opposite end of the spring/plunger mechanism 326 can be coupled to the body of the receiver 300, for example, by a plunger guide 328 or other suitable means.

As shown in FIGS. 5A-5C, the exemplary receiver 300 can include a latch trip spring or resilient member 320 that is coupled to one of the first pin 322 or the hook roller carrier 312. The latch trip spring or resilient member 320 can be configured to cooperate with the stationary hook (e.g., 200 as shown in FIGS. 6A and 6B) to easily and quickly move the hook roller 314 and hook roller carrier 312 back to a latched position on the hook roller latch 316 if the latching mechanism is inadvertently tripped while the stationary hook (e.g., 200 as shown in FIGS. 6A and 6B) is disengaged from the receiver 300. For example, as described in greater detail below, if a user inadvertently bumps or hits the receiver 300 and causes the hook roller 314 and hook roller carrier 312 to move from a position where the stationary hook (e.g., 200 as shown in FIGS. 6A and 6B) is intended to be disengaged from the receiver 300 (i.e., the hook roller 314 and hook roller carrier 312 are intended to be in a latched position on the hook roller latch 316 and in a position ready to receive the stationary hook 200, as shown in FIGS. 6A and 6B) to a position in which the stationary hook (e.g., 200 as shown in FIGS. 6A and 6B) is intended to be engaged with the hook roller 314 in the receiver 300 (i.e., the hook roller 314 and hook roller carrier 312 are in an unlatched position from the hook roller latch 316), the latch trip spring or resilient member 320 provides means for quickly and easily resetting the latching mechanism of the receiver such that the hook roller 314 and hook roller carrier 312 can be returned to the latched position on the hook roller latch 316 such that they are in a position ready to receive the stationary hook (e.g., 200 as shown in FIGS. 6A and 6B).

With reference to FIGS. 6A and 6B, an exemplary embodiment of a stationary hook 200 will now be described. The stationary hook 200 can be coupled to an interior surface 118 surrounding the oven cavity (shown in FIG. 2). The stationary hook 200 can be mounted on the surface 118 or recessed in an opening or depression formed in the surface 118, for example, such that a base 201 of the stationary hook is flush with the surface 118. The stationary hook 200 can include a hook end 202 at an opposite end from the base 201. The hook 200 can include a recess or notch 204 on a lower side of the hook 200 for engaging the hook roller 314 of the receiver 300 and securing the hook 200 within the receiver 300, as will described below. The stationary hook 200 can include an angled or curved cam surface 206 on an upper side that extends from the hook end 202 toward the base 201. The angled or curved cam surface 206 can have an upwardly sloping surface extending away from the hook end 202 toward the base 201, or a convex curved surface extending away from the hook end 202 toward the base 201, for guiding the fixed roller 310 of the receiver 300 such that the movement of the fixed roller 310 over the angled or curved cam surface 206 in a direction toward the base 201 causes the receiver 300 to move or be lifted upward in a vertical direction as the receiver is engaged on the stationary hook 200. As explained in greater detail below, in this way, the fixed roller 310 and the stationary hook 200 can cooperate to self-align the receiver 300 with the stationary hook 200 and correct for any sag that may be present in the oven door (e.g., 106 in FIGS. 1-3). The angled or curved cam surface 206 is not limited to the exemplary embodiment illustrated in the Figures and can include one or more angled and/or curved cam surfaces configured to guide the fixed roller 310 over the upper surface of the hook 200 to self-align and self-correct for any sagging condition of the door. For example, the surface 206 can be formed from a plurality of stepped portions or a plurality of curved portions, or a combination of both. The stepped portions and/or the curved portions can have similar or the same angles/slopes, or different angles/slopes. For example, the angle or curve can increase (e.g., continuously, gradually, or in steps) in a direction extending away from the hook end 202 toward the base 201, for example, to increase an amount of vertical lift of the receiver 300 as the fixed roller 310 moves closer to the base 201 of the hook 200, thereby enabling the exemplary embodiment to correct a larger amount of sag over a shorter amount of horizontal movement of the receiver 300 with respect to the hook 200. The exemplary embodiments also can provide a smooth operation of the receiver 300 and hook 200 while correcting a large amount of sag.

With reference again to FIGS. 6A and 6B, the stationary hook 200 optionally can include a horizontal cam surface 208 on an upper side of the hook 200 extending between the angled or curved cam surface 206 and the base 201. The horizontal cam surface 208 can be configured to engage the fixed roller 310 and guide the hook 200 in a straight line into engagement with the components of the receiver 300 after the receiver 300 is aligned by the surface 206 to correct for any sag.

With reference again to FIGS. 6A and 6B, the hook end 202 of the stationary hook 200 can include a second angled or curved cam surface 210 that curves downward away from the hook end 202 and toward the recess or notch 204. The second angled or curved cam surface 210 can be configured to engage and move the hook roller 314 into a reset position when the latch mechanism is inadvertently tripped prior to the hook 200 being received by the receiver 300. The second angled or curved cam surface 210 also can extend toward and cooperate with the recess or notch 204 to form a hook portion or finger hook portion for securely holding the hook roller 14 in the recess or notch 204 when the receiver 300 engages the hook 200.

With reference again to FIGS. 6A and 6B, an example of an operation of closing a side swing door of an appliance having an exemplary embodiment of a receiver 300 and hook 200 will now be described.

As shown in FIG. 6A, as the receiver 300 moves toward the hook 200, the hook end 202 of the hook 200 approaches the opening 308 of the receiver 300. In FIG. 6A, the receiver 300 is in a "ready" position intended to receive the hook 200. That is, the rocker arm 324 is positioned such that the hook roller carrier 312 is shifted toward the opening 308 and the hook roller 314 is engaged or latched on the hook roller latch 316. As shown in FIG. 6A, the hook roller latch 316 can include a stop 334, such as a notch or curved surface, that receives the first pin 322 and prevents the rocker arm 324 and the hook roller carrier 312 from rotating any further toward the opening 308 of the receiver 300.

FIG. 6A illustrates an example in which sagging is present in the door. As shown in FIGS. 6A and 6B, due to the sagging condition, the angled or curved cam surface 206 will engage the lower side of the fixed roller 310 as the receiver 300 moves toward the hook 200 and the hook 200 is received within the opening 308. As shown in FIG. 6B, the roller 310 cooperates with the stationary hook 200 to align the door 106 with the oven chassis and self correct for a sagging condition of the door 106. Particularly, as the roller 310 moves over the surface 206 of the hook 200, the receiver 300 is lifted vertically (as shown by the arrows) with respect to the hook 200 to self-correct for sag and self-align the receiver with the hook 200. As the roller 310 continues to move across the horizontal surface 208 of the hook, the receiver 300 is guided in a straight line into engagement with the hook 200. One of ordinary skill in the art will recognize that, if a sagging condition is not present, the angled or curved cam surface 206 may not engage the lower side of the fixed roller 310 at all as the receiver 300 moves toward the hook 200.

With reference again to FIG. 6B, as the receiver 300 is guided in a straight line (by the movement of the fixed roller 310 over the surface 208) into engagement with the hook 200, the hook end 202 can engage and move the latch trip spring 318 in a direction away from the opening 308, which causes the hook roller carrier 312 to rotate about the first pin 322 and release the hook carrier 314 from the hook carrier latch 316. One of ordinary skill in the art will recognize that, if a sagging condition is not present, the horizontal surface 208 also may not engage the lower side of the fixed roller 310 at all as the receiver 300 moves toward the hook 200. Subsequently or simultaneously to the hook end 202 engaging and moving the latch trip spring 318, the rocker arm 324 rotates in a counterclockwise direction from the position shown in FIG. 6A to the position shown in FIG. 6B. During this movement, the hook roller 314 is brought into engagement with the recess or notch 204 of the hook 200 (as shown in FIG. 6B), thereby pulling the hook 200 into the receiver 300 and securing the hook 200 within the receiver 300. Additionally, during this movement, the spring/plunger mechanism 326 rotates about the second pin 332 with respect to the rocker arm 324 from the position shown in FIG. 6A to the position shown in FIG. 6B.

The rocker arm 324 and spring/plunger mechanism 326 can be selected such that a predetermined amount of closing force (e.g., 10 pounds of closing force) is applied to the hook 200 by the receiver 300 to secure and hold the side swing door against the sealing element of the oven chassis in the closed position and to maintain a suitable amount of pressure on the oven door seal in order to provide a safe and robust side swing door for a home cooking appliance. For example, in the illustrated exemplary embodiment, as the hook 200 first engages the receiver 300, the hook 200 engages the hook roller 314 and is pulled by the hook roller 314, due to the rotating rocker arm 324 and the rotating hook roller carrier 312, into the receiver 300 with limited or no effort by the user. In an embodiment, the pulling force applied to the hook 200 can begin at a smaller amount of force as the rocker arm 324 and the hook roller carrier 312 begin to rotate counter-clockwise and an angle of the spring/plunger mechanism 326 with respect to the rocker arm 324 is small, and then increase to a larger amount of force as an angle of the spring/plunger mechanism 326 with respect to the rocker arm 324 is increased, thereby providing an end force necessary to sufficiently seal the door against the sealing element of the chassis of the appliance. For example, the pulling force can begin at, for example, 3 lbs when the angle of the spring/plunger mechanism 326 with respect to the rocker arm 324 is small or minimal. Then, the pulling force can be increased to and end at, for example, 10 lbs of force when the angle of the spring/plunger mechanism 326 with respect to the rocker arm 324 is larger or maximized. In this way, the exemplary embodiments can require very little force to trip the mechanism upon closing the door, thereby improving the tactile perception to the user during the closing of the door, while at the same time providing the necessary force required to sufficiently seal the door against the sealing element of the chassis of the appliance. Moreover, the exemplary embodiments can securely hold the door and prevent the door from bouncing open if the door is slammed into the closed position by the user.

FIG. 6B illustrates a gap between the receiver 300 and the base 201 of the hook 200, or the surface 188 of the chassis, when the hook 200 is completely engaged and secured in the receiver 300. However, in other embodiments, the face 302 of the receiver 300 can directly abut the base 201 of the hook 200, or the surface 188 of the chassis, when the hook 200 is completely engaged and secured in the receiver 300. In other embodiments, any suitable spacing between the receiver 300 and the base 201 of the hook 200, or the surface 188 of the chassis, can be provided when the hook 200 is completely engaged and secured in the receiver 300, for example, to accommodate a temperature resistant sealing member for sealing the door to the chassis.

With reference again to FIGS. 6A and 6B, an example of an operation of opening a side swing door of an appliance having an exemplary embodiment of a receiver 300 will now be described. In the exemplary embodiment, the steps of the opening operation of the door are opposite to the steps of the closing operation.

For example, with reference again to FIG. 6B, when a user applies a pulling force on the side swing door, the hook end 202 and the recess or notch 204 of the hook 200 will pull on the hook roller 314, which will cause the rocker arm 324 to begin rotating in a clockwise direction from the position shown in FIG. 6B to the position shown in FIG. 6A and cause the hook roller carrier 312 to begin to rotate about the first pin 322 in a clockwise direction toward the opening 308. During this movement, the spring/plunger mechanism 326 rotates about the second pin 332 with respect to the rocker arm 324 from the position shown in FIG. 6B to the position shown in FIG. 6A. As the movement is completed, the hook roller 314 can be disengaged from the recess or notch 204 of the hook 200 (as shown in FIG. 6A), thereby permitting the hook 200 to be removed from the receiver 300 such that the side swing door can be opened fully. In the illustrated exemplary embodiment, due to the rotating rocker arm 324 and the rotating hook roller carrier 312, the hook 200 can be disengaged and removed from the receiver 300 with limited or no effort by the user after the initial application of opening force. During the removal of the hook 200 from the receiver 300, the movement of the fixed roller 310 over the surface 208 of the hook 200 will guide the receiver 300 in a straight line away from the base 201 of the hook 200 until the hook 200 is released entirely from the receiver 300, thereby providing a smooth operation and tactile perception to the user. As shown in FIG. 6A and explained above, the hook roller latch 316 can include a stop 334, such as a notch or curved surface, that receives the first pin 322 and prevents the rocker arm 324 and the hook roller carrier 312 from rotating any further toward the opening 308 of the receiver 300.

The rocker arm 324 and spring/plunger mechanism 326 can be selected such that the user must apply a predetermined amount of pulling force (e.g., 10 pounds of closing force) to the door, and by extension to the hook 200, to overcome the force of the receiver 300 that secures and holds the side swing door against the sealing element of the oven chassis in the closed position. In an embodiment, the pulling force applied to the hook 200 can begin at a larger amount of force as the rocker arm 324 and the hook roller carrier 312 begin to rotate clockwise and an angle of the spring/plunger mechanism 326 with respect to the rocker arm 324 is larger, and then decrease to a lesser amount of force as an angle of the spring/plunger mechanism 326 with respect to the rocker arm 324 is decreased. For example, the pulling force applied by the user can begin at, for example, 10 lbs when the angle of the spring/plunger mechanism 326 with respect to the rocker arm 324 is larger or maximized. Then, the necessary pulling force applied by the user can be reduced to, for example, 3 lbs of force when the angle of the spring/plunger mechanism 326 with respect to the rocker arm 324 is lessened or minimized. Once the hook 200 is disengaged from the hook roller 314, the user can freely open the door with minimal or no force.

In this way, the exemplary embodiments can be configured such that, as the hook 200 is removed from the receiver 300, the required pull force applied by the user varies such that the pull force decreases throughout the opening operation of the door until the hook 200 disengages from the receiver 300. More particularly, in an exemplary embodiment, the present invention can be specifically and intentionally configured such that, as the hook 200 is removed from the receiver 300 (i.e., as the door is pulled open by a user), the required pull force starts at for example 10 lbs, then decreases from 10 lbs to for example 3 lbs, and then disengages altogether to free the hook 200 from the receiver 300. In this way, the present invention can improve the tactile perception to the user during the opening of the door, while at the same time providing the necessary force during the closed position to sufficiently seal the door against the sealing element of the chassis of the appliance. Moreover, the exemplary embodiments can securely hold the door and prevent the door from bouncing open if the door is slammed into the closed position by the user.

With reference to FIGS. 7A-7E, an example of an operation of an exemplary embodiment of a receiver 300 will now be described in which the latching mechanism has been inadvertently tripped into a position intended for securing the hook 200 in the receiver 300 while the hook 200 is disengaged from the receiver 300. As explained above and shown in FIGS. 7A-7E, the exemplary receiver 300 can include a latch trip spring or resilient member 320 that is coupled to one of the first pin 322 or the hook roller carrier 312. The latch trip spring or resilient member 320 can be configured to cooperate with the stationary hook 200 to easily and quickly move the hook roller 314 and hook roller carrier 312 back to a latched position on the hook roller latch 316 in the event the latching mechanism has been inadvertently tripped while the stationary hook 200 is disengaged from the receiver 300.

Figure 7A:
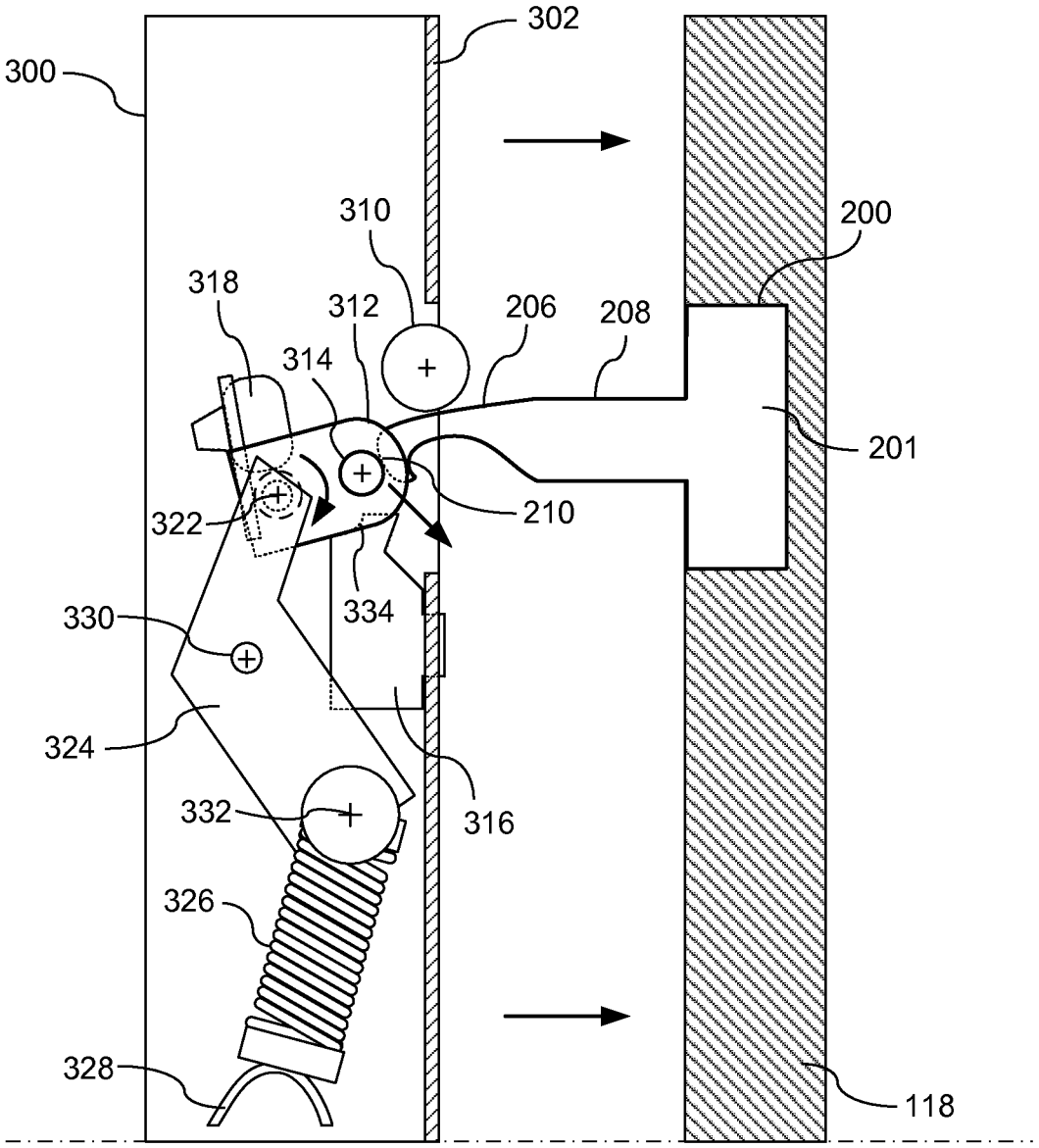
FIGS. 7A, 7B, 7C, 7D, and 7E are partial side views schematically illustrating an operation of an integral self capturing latch of a side swing door of a home cooking appliance, according to an exemplary embodiment of the invention.
Figure 7B:
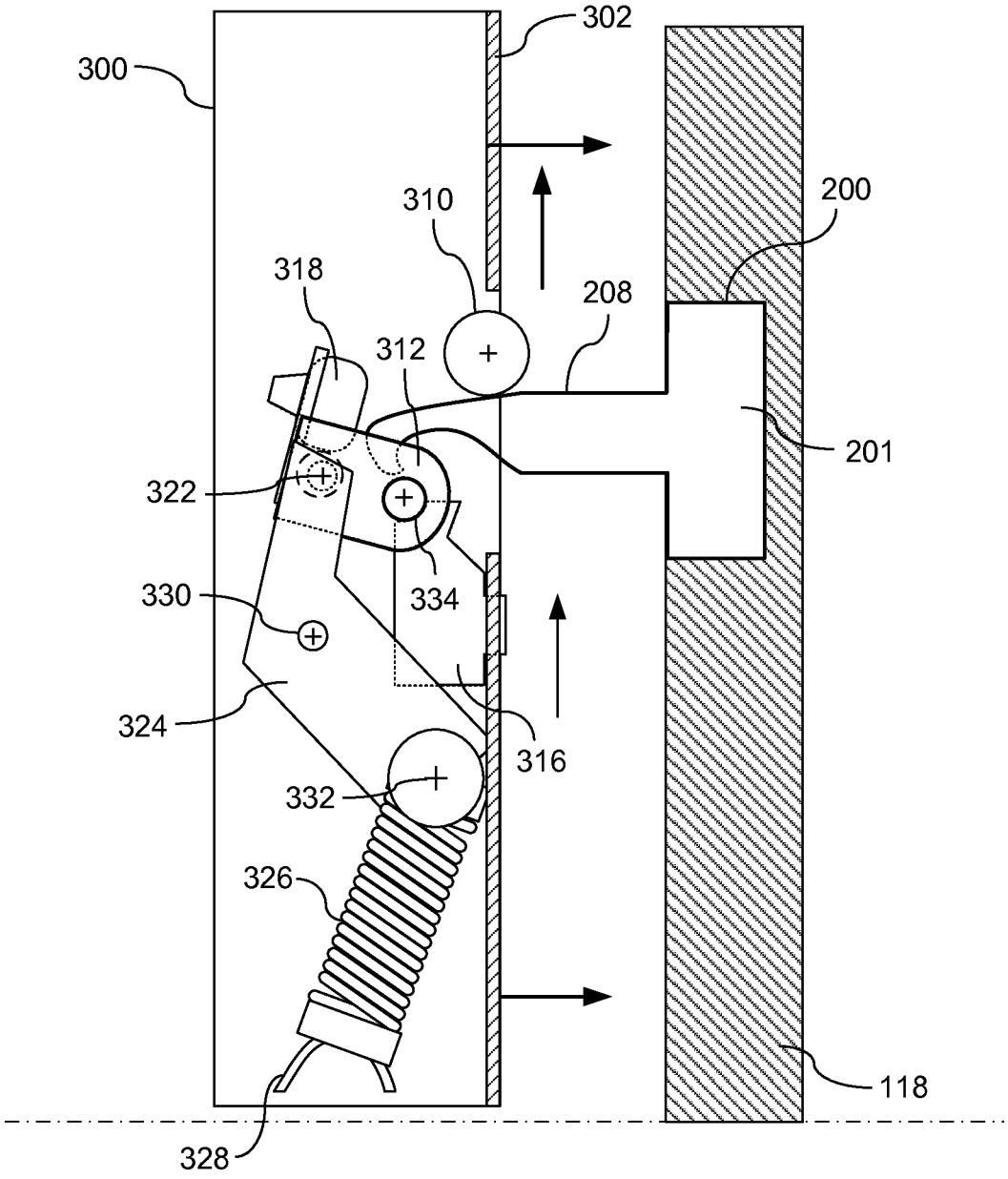

As shown in FIG. 7A, as the receiver 300 moves toward the hook 200, the hook end 202 of the hook 200 approaches the opening 308 of the receiver 300. In FIG. 7A, the receiver 300 is in a position intended to already have secured the hook 200. That is, the rocker arm 324 is positioned such that the hook roller carrier 312 is shifted away the opening 308 and the hook roller 314 is disengaged or unlatched from the hook roller latch 316. FIG. 7A illustrates an example in which sagging is present in the door. As shown in FIGS. 7A and 7B, due to the sagging condition, the angled or curved cam surface 206 will engage the lower side of the fixed roller 310 as the receiver 300 moves toward the hook 200 and the hook 200 is received within the opening 308. As shown in FIG. 7B, the roller 310 cooperates with the stationary hook 200 to align the door 106 with the oven chassis and self correct for a sagging condition of the door 106. Particularly, as the roller 310 moves over the surface 206 of the hook 200, the receiver 300 is lifted vertically with respect to the hook 200 to self-correct for sag and self-align the receiver 300 with the hook 200. As the roller 310 continues to move across the horizontal surface 208 of the hook, the receiver 300 is guided in a straight line into engagement with the hook 200. One of ordinary skill in the art will recognize that, if a sagging condition is not present, the angled or curved cam surface 206 may not engage the lower side of the fixed roller 310 at all as the receiver 300 moves toward the hook 200.

Figure 7C:
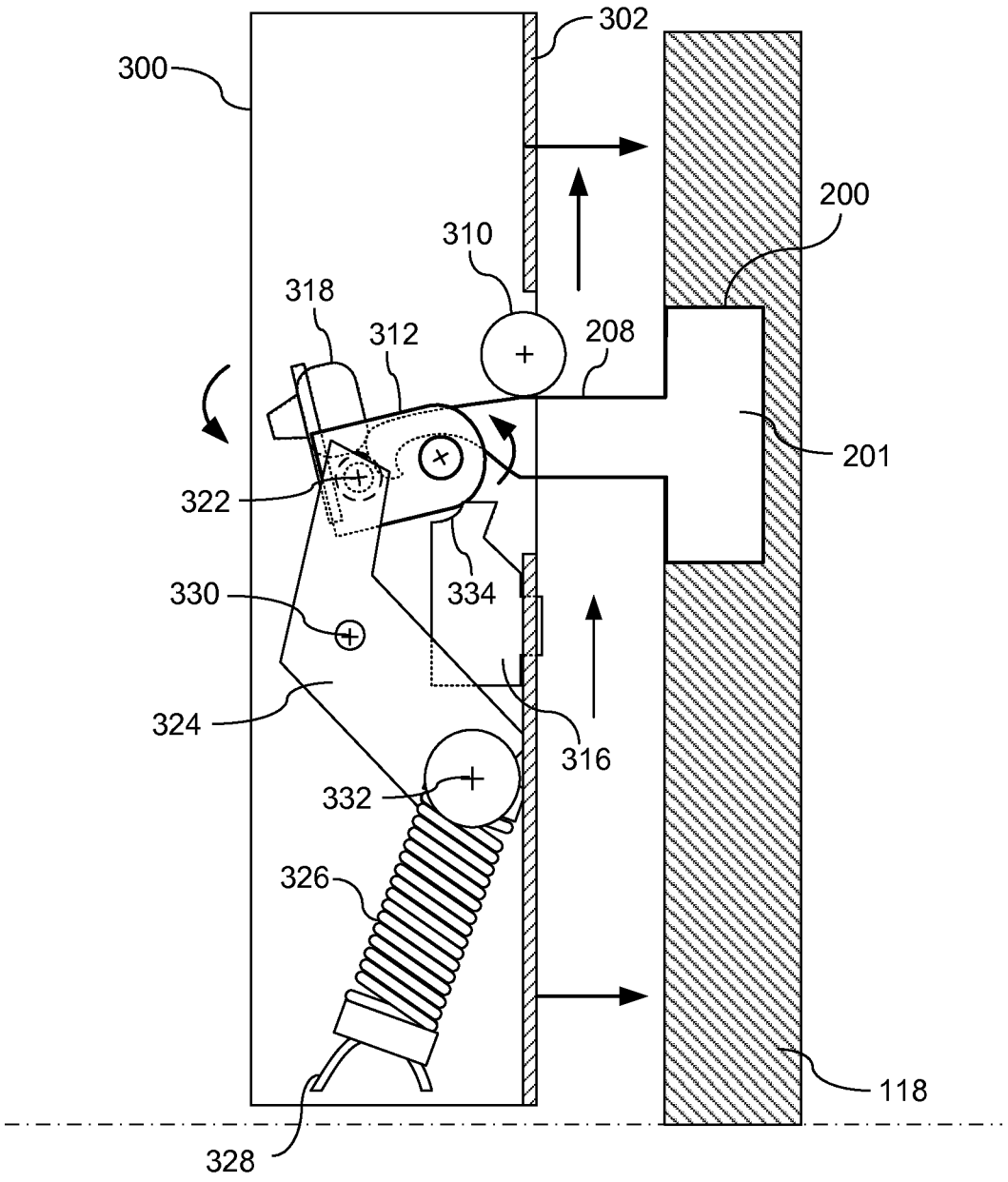
Figure 7D:
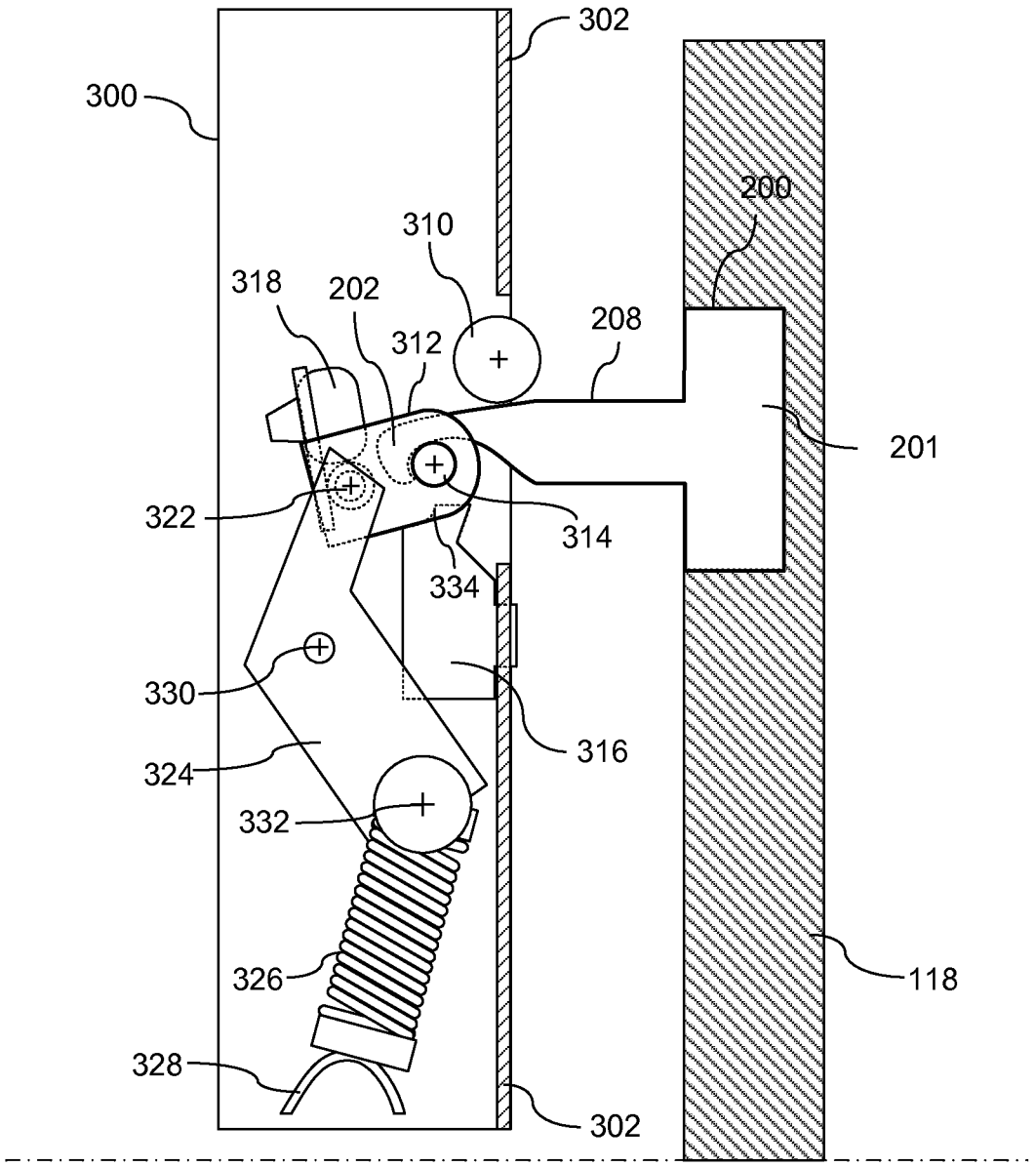

With reference again to FIGS. 7A and 7B, as the receiver 300 is guided in a straight line (by the movement of the fixed roller 310 over the surface 208) into engagement with the hook 200, depending on the position of the hook roller 314, the second angled or curved surface 210 of the hook 200 can engage a surface of the hook roller 314, as shown in FIG. 7A, and cause the hook roller 314 to move downward and out of the way of the hook end 202, as shown in FIG. 7B. As the receiver 300 continues to be guided in a straight line (by the movement of the fixed roller 310 over the surface 208) into engagement with the hook 200, the hook end 202 can engage and move the latch trip spring 318 in a direction away from the opening 308, as shown in FIG. 7C. Since the latch trip spring 318 is a spring or resilient member, the hook end 202 can be pressed with sufficient force by the user to flex the latch trip spring 318 and permit the hook 200 to move further into the receiver 300. When the user lessens the force or stops applying the force on the door, the resiliency of the latch trip spring 318 can cause the hook roller carrier 312 to move, or snap back, toward the opening 308 of the carrier 300. As shown in FIG. 7D, if the hook 200 remains in the receiver 300, the latch trip spring 318 can cause the hook roller carrier 312 to rotate about the first pin 322 and the hook roller 314 to engage and hook the recess or notch 204 of the hook 200, thereby resetting the latch and securing the hook 200 in the receiver 300 in a single step.

Figure 7E:
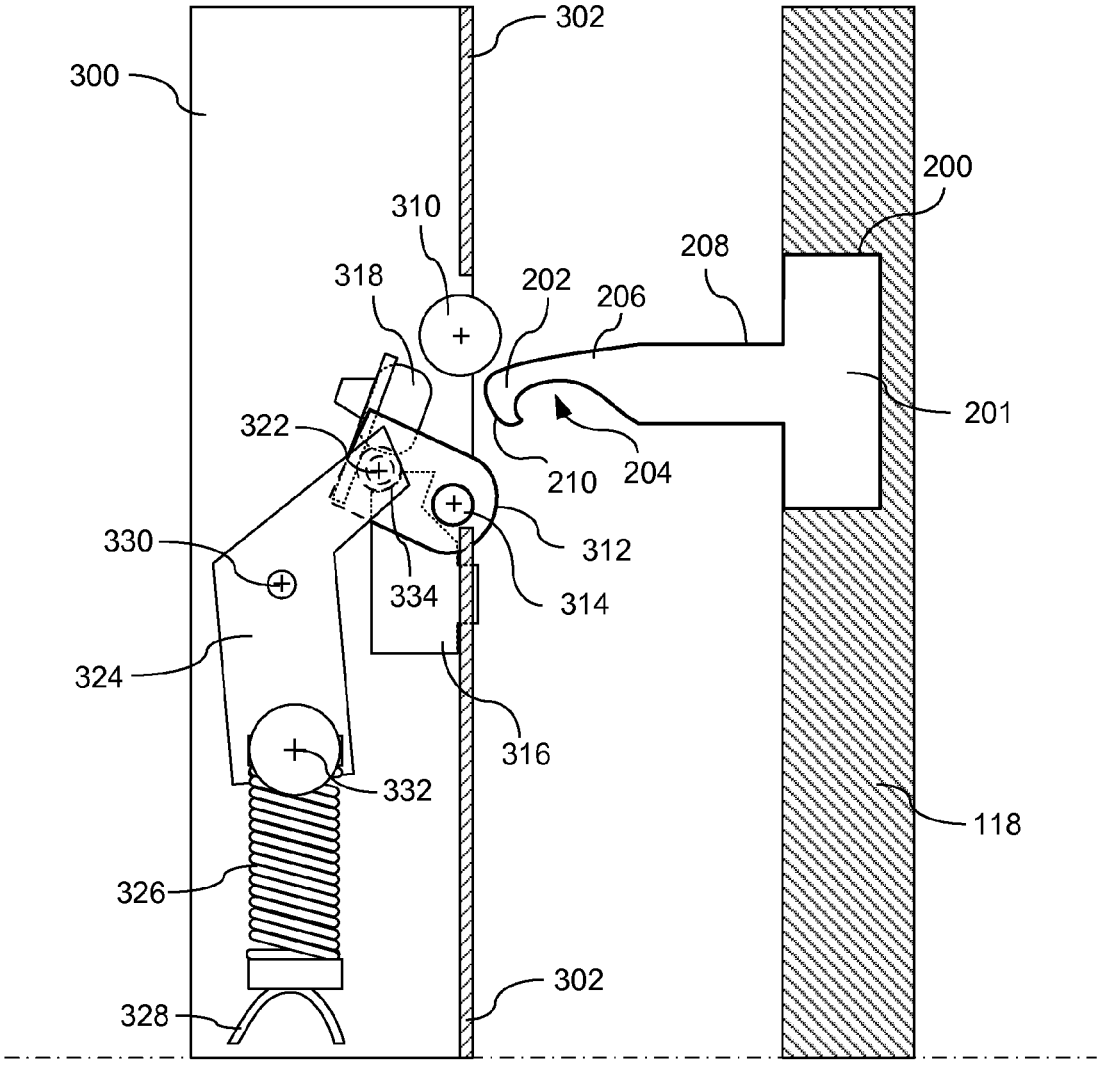
Figure 8A:
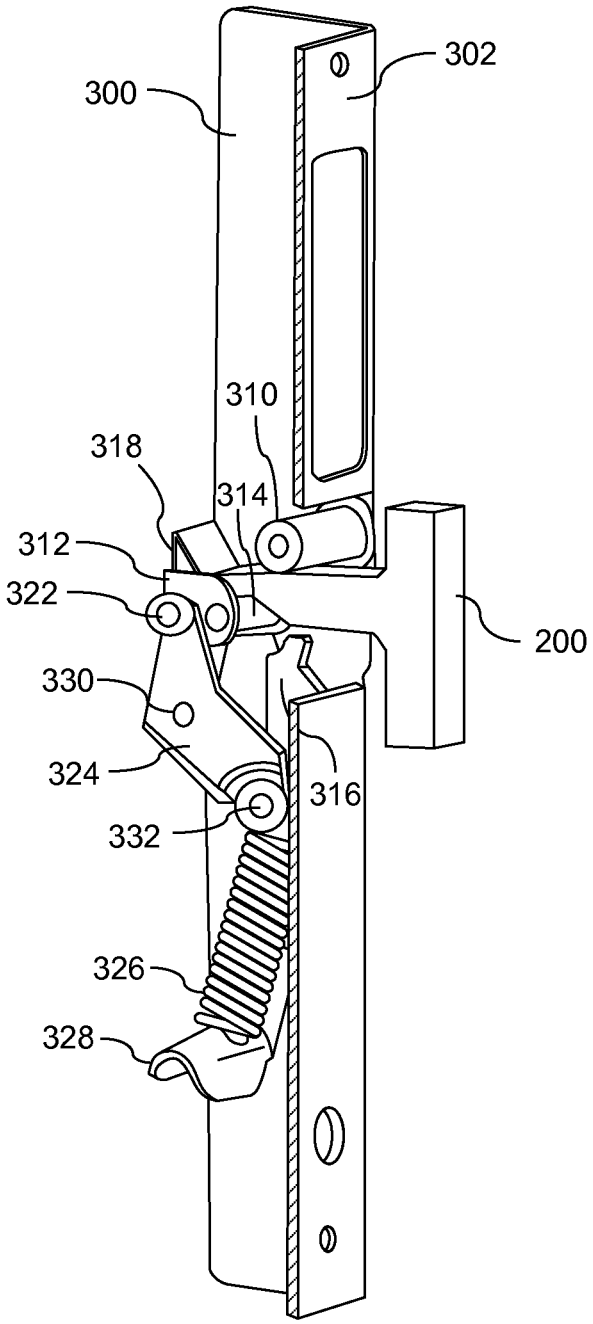
FIGS. 8A and 8B are partial perspective views schematically illustrating an operation of an integral self capturing latch of a side swing door of a home cooking appliance, according to another exemplary embodiment of the invention.
Figure 8B:
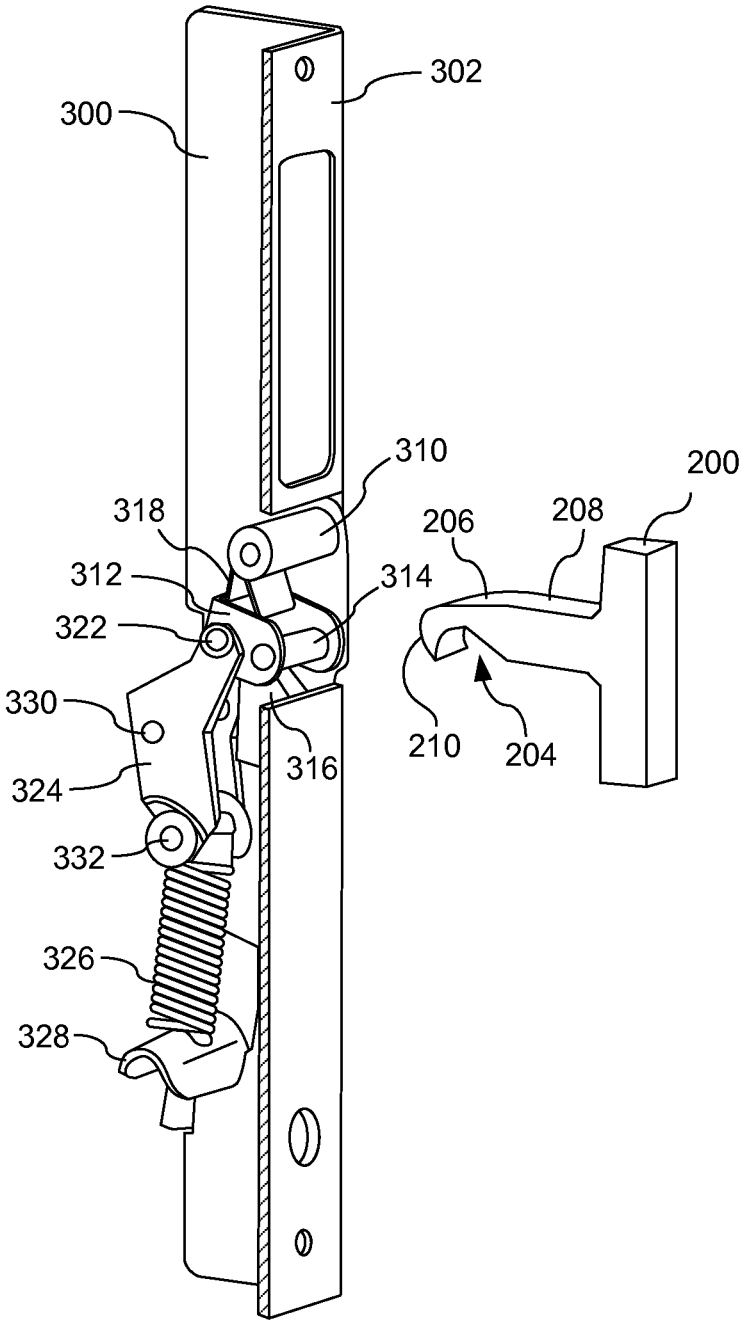
Figure 9A:
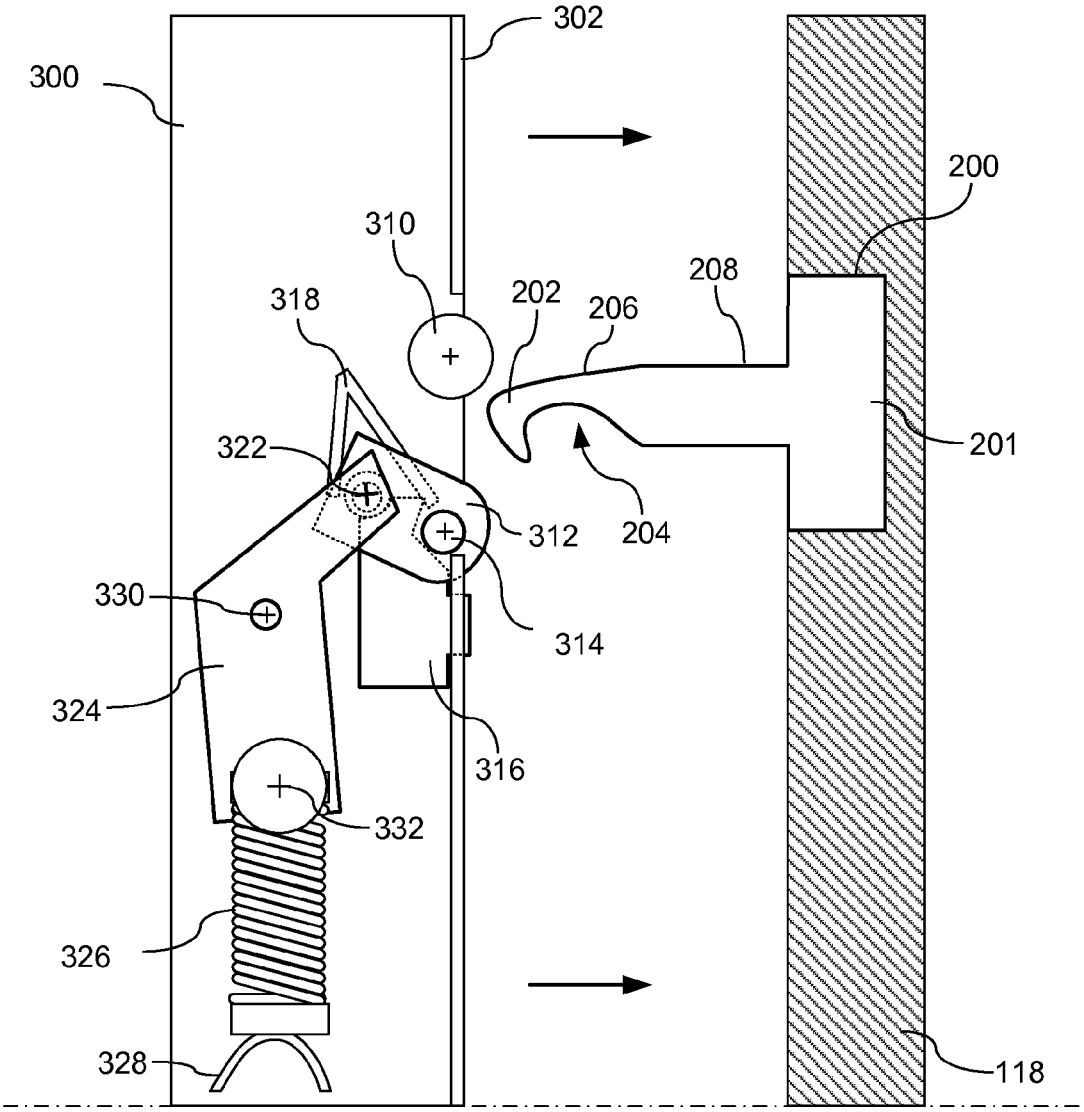
FIGS. 9A and 9B are partial side views schematically illustrating an operation of the integral self capturing latch according to the exemplary embodiment of the invention illustrated in FIGS. 8A and 8B.
Figure 9B:
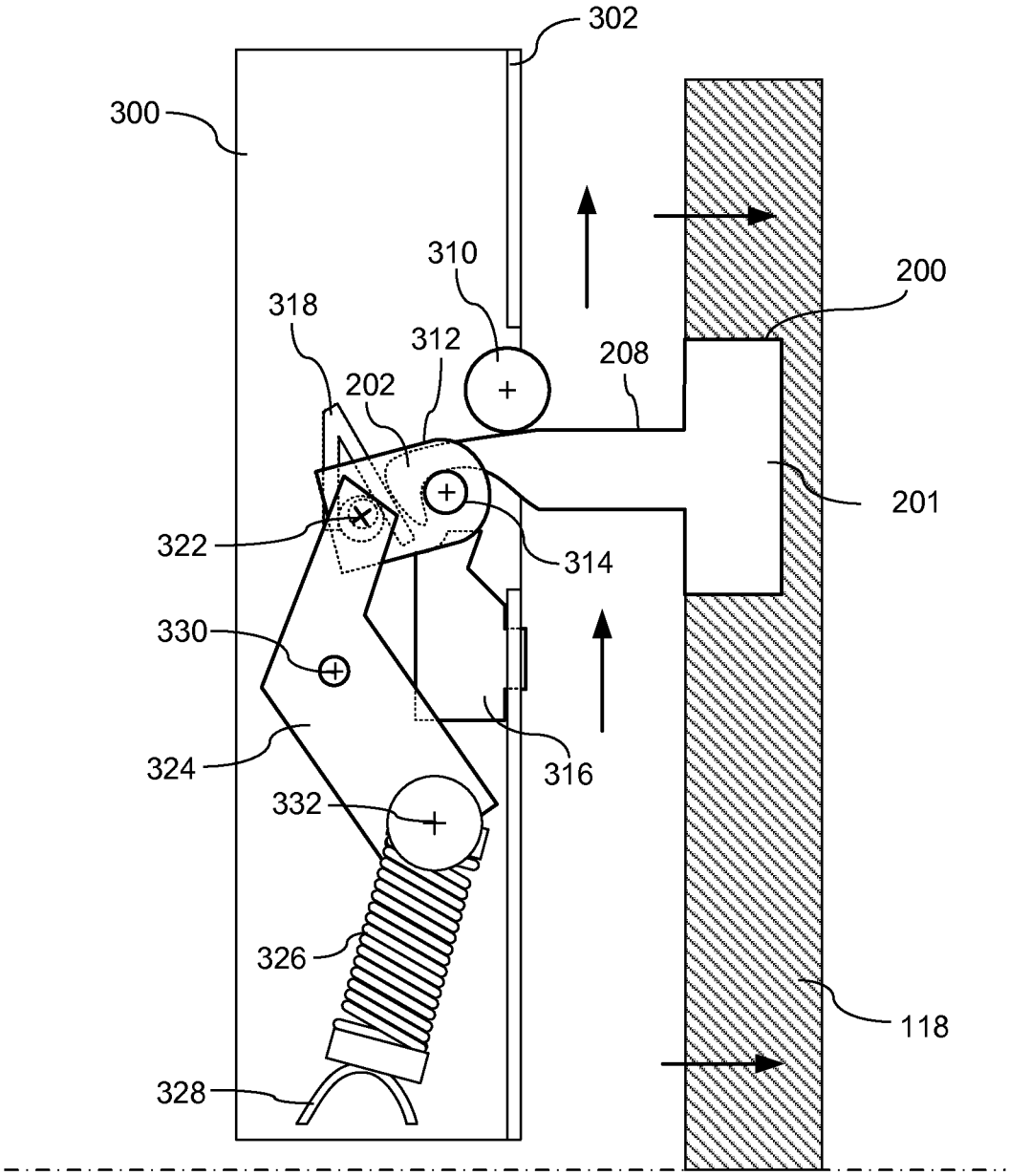

Alternatively, the latch trip spring 318 can be configured such that the force applied by the user on the door will push the hook end 202 of the hook 200 against the latch trip spring 318 and cause the latch trip spring 318 to rotate counterclockwise, which will thereby apply force on the top end of the rocker arm 324 in the opposite direction, until the rocker arm 324 moves in a clockwise direction from the position shown in FIG. 7A to the "ready" position shown in FIG. 7E (similar to the "ready" position shown in FIG. 6A). Particularly, if the user partly opens the door and the hook 200 is removed from the receiver 300 after force is applied to the latch trip spring 318, the latch trip spring 318 can cause the hook roller carrier 312 to rotate about the first pin 322 and the hook roller 314 toward the opening until the first pin 322 abuts the stop 334 of the hook roller latch 316 and the hook roller 314 is latched onto the hook roller latch 316, thereby returning the receiver 300 to a "ready" position illustrated in FIG. 7E (similar to the "ready" position shown in FIG. 6A). During this movement, the spring/plunger mechanism 326 can rotate about the second pin 332 with respect to the rocker arm 324 from the position shown in FIG. 7A to the position shown in FIG. 7E. As a result, the receiver 300 can be quickly and easily returned or reset to a "ready" position (shown in FIG. 7E and similarly shown in FIG. 6A) for receiving the hook 200 in the event that the latching mechanism is inadvertently tripped while the hook 200 is disengaged from the receiver 300. Additionally, the exemplary latch trip spring 318 also can provide separate and/or additional advantages of absorbing sound, thereby reducing the noise associated with closing the door and improving the audible perception of the latch to the user. One of ordinary skill in the art will recognize that, if a sagging condition is not present, the horizontal surface 208 also may not engage the lower side of the fixed roller 310 at all as the receiver 300 moves toward the hook 200.

As shown in FIGS. 6A, 6B, and 7A-7E, the exemplary latch trip spring 318 can be formed from a resilient material in a shape of, for example, a round bumper. The resilient material can be coupled to a rigid or flexible support for connecting the resilient material to one of the first pin 322 or the hook carrier roller 312, or integrally formed in a single piece that can be coupled to one of the first pin 322 or the hook carrier roller 312. The exemplary latch trip spring 318 is not limited to the illustrated embodiment and can include any suitable material, size, and shape to provide the latch tripping function and/or the reset function.

For example, as shown in FIGS. 8A, 8B, 9A, and 9B, the exemplary latch trip spring 318 can be formed from a resilient material, such as a thin piece of metal bent or shaped into a plate spring, leaf spring, or the like. The resilient material can be coupled to a rigid or flexible support for connecting the resilient material to one of the first pin 322 or the hook carrier roller 312, or integrally formed in a single piece that can be coupled to one of the first pin 322 or the hook carrier roller 312.

In operation, the components of the receiver 300 and the hook 200 of the exemplary embodiments illustrated in FIGS. 8A-9B interact with each other during the closing operation, opening operation, and rest operation in a similar manner as the exemplary embodiment illustrated in FIGS. 6A-7E, and therefore, a description of their operation will not be repeated here.

The exemplary embodiments of the present invention can be configured such that one or more, or all, of the components of the receiver 300 and the hook 200 can withstand elevated temperatures of, for example, 90-100° C.

One of ordinary skill in the art will recognize that the Figures are schematic illustrations of the exemplary embodiments, and that the particular size, shape, fit, and tolerances can be modified or varied to provide the necessary rotation, clearance, engagement, and operation of the illustrated components.

As explained above, an exemplary embodiment of the invention is directed to a home cooking appliance 100 comprising a housing 118 having a cooking cavity 114; a side swing door 106 movable between a closed position and an open position to provide access to the cooking cavity 114; and a self capturing latch mechanism 200, 300 that secures and seals the side swing door 106 in the closed position, the self capturing latch mechanism 200, 300 including a stationary hook 200 and a receiver 300 that receives and draws a part of the stationary hook 200 into a secured position within the receiver 300 when the side swing door 106 is moved into the closed position to secure the side swing door 106 in the closed position, the stationary hook 200 and the receiver 300 being mounted on opposing surfaces of the housing 118 and the side swing door 106 that face each other when the side swing door 106 is in the closed position, and the receiver 300 providing a variable closing force that varies from a first closing force (e.g., 3 pounds) at an initial engagement of the receiver 300 with the part of the stationary hook 200 to a predetermined second closing force (e.g., 10 pounds), which is greater than the first closing force, at a completed engagement of the receiver 300 with the part of the stationary hook 200 to seal the side swing door 106 in the closed position. The receiver 300 can be mounted on the surface of the side swing door 106 and the stationary hook 200 can be mounted on the housing 118. The receiver 300 can include a spring loaded latching mechanism (e.g., e.g., 312, 314, 324, and/or 326) actuated by contact with the part of the stationary hook 200 received in the receiver 300, wherein the actuated spring loaded latching mechanism (e.g., 312, 314, 324, and/or 326) draws the part of the stationary hook 200 into the receiver 300 with a force that increases from a first predetermined closing force (e.g., 3 pounds), which is capable of drawing the part of the stationary hook 200 into the receiver 300, to a predetermined second closing force (e.g., 10 pounds), which is capable of maintaining the side swing door 106 in the closed position in a sealed state. The predetermined second closing force can be equal to or greater than 10 pounds, while the predetermined first closing force can equal to or greater than 3 pounds and less than 10 pounds. The spring loaded latching mechanism (e.g., 312, 314, 324, and/or 326) can be actuated to release from the closed position in the sealed state actuated by an application of a pulling force by a user, the pulling force being equal to or greater than the predetermined second closing force (e.g., 10 pounds) and decreasing to the first predetermined closing force (e.g., 3 pounds) during a release of the side swing door 106 from the closed position in the sealed state.

Another exemplary embodiment of the invention is directed to a home cooking appliance (e.g., 100) comprising a housing (e.g., 118) having a cooking cavity (e.g., 114); a side swing door (e.g., 106) movable between a closed position and an open position to provide access to the cooking cavity (e.g., 114); and means (e.g., 300) for latching the side swing door in the closed position on the housing, the means (e.g., 300) for latching including means (e.g., 310, or 310 and 206) for self-correcting for a sagging condition of the side swing door (e.g., 106) by lifting the side swing door (e.g., 106) in an upward vertical direction during movement of the side swing door (e.g., 106) from the open position to the closed position.

An exemplary embodiment of the home cooking appliance can further comprise means (e.e.g., 312, 314, 324, and/or 326) for pulling the side swing door (e.g., 106) toward the housing (e.g., 118) with a variable pulling force, wherein a first pulling force (e.g., approximately 3 lbs. of force) applied to the side swing door (e.g., 106) during an initiation of a latching process, when the side swing door (e.g., 106) is moved from the open position to the closed position, is less than a second pulling force (e.g., approximately 10 lbs. of force) applied to the side swing door (e.g., 106) at a completion of the latching process, wherein the second pulling force is a predetermined pulling force for sealing the door (e.g., 106) to the housing (e.g., 118).

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing having a cooking cavity;

a side swing door movable between a closed position and an open position to provide access to the cooking cavity; and a self capturing latch mechanism that secures and seals the side swing door in the closed position, the self capturing latch mechanism including:

a stationary hook; and a receiver that receives and draws a part of the stationary hook into a secured position within the receiver when the side swing door is moved into the closed position to secure the side swing door in the closed position, the stationary hook and the receiver being mounted on opposing surfaces of the housing and the side swing door that face each other when the side swing door is in the closed position, and the receiver providing a variable closing force that varies from a first predetermined closing force at an initial engagement of the receiver with the part of the stationary hook to a second predetermined closing force, which is greater than the first predetermined closing force, at a completed engagement of the receiver with the part of the stationary hook to seal the side swing door in the closed position, and the receiver receiving a variable opening force, in response to an application of a pulling force on the receiver by a user, that varies from a first predetermined opening force at an initial disengagement of the receiver from the part of the stationary hook to a second predetermined opening force, which is less than the first predetermined opening force, at a completed disengagement of the receiver from the part of the stationary hook when the side swing door is in the open position;

the receiver comprising:

a receiver body having an opening for receiving the part of the stationary hook;

a rocker arm having a first end and a second end, the first end being opposite the second end, the rocker arm being pivotably coupled at a location between the first end and the second end to a fixed point on the receiver body;

a hook roller carrier pivotably coupled to the first end of the rocker arm and moveable with the first end of the rocker arm;

a hook roller being mounted on the hook roller carrier and movable with the hook roller carrier, the hook roller configured to engage the part of the stationary hook to secure the side swing door in the closed position;

a spring/plunger mechanism having an upper end and a lower end, the upper end being pivotably coupled to the second end of the rocker arm and movable with the second end of the rocker arm, and the lower end being pivotably coupled to a fixed point on the receiver body;

a hook roller latch fixed to the receiver body, the hook roller latch being disposed adjacent to the opening in the receiver body;

wherein the hook roller is configured to engage a surface of the hook roller latch when the hook roller is disengaged from the part of the stationary hook.

2. The home cooking appliance of claim 1, wherein the receiver is mounted on the surface of the side swing door and the stationary hook is mounted on the opposing surface of the housing.

3. The home cooking appliance of claim 1, wherein the actuated spring loaded latching mechanism draws the part of the stationary hook into the receiver with a force that increases from a first predetermined closing force, which is capable of drawing the part of the stationary hook into the receiver, to a predetermined second closing force, which is capable of maintaining the side swing door in the closed position in a sealed state.

4. The home cooking appliance of claim 3, wherein the second predetermined closing force is equal to or greater than 10 pounds.

5. The home cooking appliance of claim 4, wherein the first predetermined closing force is equal to or greater than 3 pounds and less than 10 pounds.

6. The home cooking appliance of claim 3, wherein the spring loaded latching mechanism is actuated to release the side swing door from the closed position in the sealed state by an application of a pulling force by a user, the pulling force being equal to or greater than the predetermined second closing force and decreasing to the first predetermined closing force during a release of the side swing door from the closed position in the sealed state.

7. The home cooking appliance of claim 1, wherein the receiver further comprises a first pin pivotably coupling the hook roller carrier to the first end of the rocker arm, and wherein the hook roller latch includes a stop surface that engages the first pin and limits an amount of rotation of the rocker arm about the fixed point on the receiver body.

8. The home cooking appliance of claim 1, wherein the receiver further comprises:

a latch trip spring coupled to at least one of the hook roller carrier and the hook roller and movable with the hook roller carrier or the hook roller, the latch trip spring configured to disengage the hook roller from the surface of the hook roller latch.

9. The home cooking appliance of claim 8, wherein the latch trip spring is configured to reset the hook roller onto the surface of the hook roller latch if the self capturing latch mechanism is tripped prior to the stationary hook being received by the receiver.

10. The home cooking appliance of claim 9, wherein the stationary hook comprises:

a hook end having a second sloped or curved cam surface that curves downward away from the hook end such that, when the side swing door is moved into the closed position, the second sloped or curved cam surface of the stationary hook engages and moves the hook roller into a reset position if the self capturing latch mechanism is tripped prior to the stationary hook being received by the receiver.

11. The home cooking appliance of claim 1, wherein the stationary hook comprises:

a hook mounting base for mounting the stationary hook;

the part of the stationary hook received by the receiver includes a hook end at an opposite end from the hook mounting base; and a recess on a lower side for engaging the hook roller.

12. The home cooking appliance of claim 11, wherein the receiver further comprises a fixed roller coupled to the receiver body and disposed at the opening of the receiver body, and wherein the stationary hook further comprises a sloped or curved cam surface on an upper side, the sloped or curved cam surface engaging a lower side of the fixed roller upon the initial engagement of the receiver with the part of the stationary hook and cooperating with the lower side of the fixed roller to lift the side swing door in an upward vertical direction as the part of the stationary hook is drawn into the receiver.

13. The home cooking appliance of claim 11, wherein the hook end comprises a second sloped or curved cam surface that curves downward away from the hook end and toward the recess, wherein, when the side swing door is moved into the closed position, the second sloped or curved cam surface of the stationary hook engages and moves the hook roller into a reset position if the self capturing latch mechanism is tripped prior to the stationary hook being received by the receiver.

14. The home cooking appliance of claim 1, wherein the second predetermined closing force is equal to or greater than 10 pounds.

15. The home cooking appliance of claim 14, wherein the first predetermined closing force is equal to or greater than 3 pounds and less than 10 pounds.

16. The home cooking appliance of claim 1, wherein the receiver is configured to receive a variable releasing force, in response to the application of the pulling force on the side swing door by the user, that decreases from the predetermined second closing force, at the completed engagement of the receiver with the part of the stationary hook, to the first predetermined closing force prior to a release of the receiver from the part of the stationary hook.

17. The home cooking appliance of claim 1, wherein the rocker arm, the hook roller carrier, the hook roller, and the spring/plunger mechanism are disposed within a cavity of the receiver body.

18. The home cooking appliance of claim 1, wherein the receiver further comprises a first pin directly coupling the hook roller carrier to the first end of the rocker arm such that the hook roller carrier and the first end of the rocker arm are pivolable with respect to each other about the first pin.

19. The home cooking appliance of claim 18, wherein the receiver further comprises a latch trip spring coupled to the hook roller carrier, the latch trip spring being pivolable along with the hook roller carrier, about the first pin.

20. The home cooking appliance of claim 19, wherein the latch trip spring includes a resilient material that absorbs sounds resulting from contact between the stationary hook and the latch trip spring.

21. The home cooking appliance of claim 7, wherein the receiver further comprises a latch trip spring coupled to the hook roller carrier, the latch trip spring being pivolable along with the hook roller carrier, about the first pin, the latch trip spring configured to disengage the hook roller from the surface of the hook roller latch.

22. A home cooking appliance comprising:

a housing having a cooking cavity;

a side swing door movable between a closed position and an open position to provide access to the cooking cavity; and self capturing latch means for securing and sealing the side swing door in the closed position, the self capturing latch means including a stationary hook and a receiver for pulling the side swing door toward the housing with a variable closing force, wherein a first closing force applied to the side swing door during an initiation of a latching process, when the side swing door is moved from the open position to the closed position, is less than a second closing force applied to the side swing door at a completion of the latching process, and wherein the second closing force is a predetermined closing force for sealing the side swing door to the housing, the self capturing latch means receiving a variable opening force, in response to an application of a pulling force on the side swing door by a user, that varies from a first predetermined opening force at an initial disengagement of the side swing door from the closed position to a second predetermined opening force, which is less than the first predetermined opening force, when the side swing door is in the open position;

the receiver comprising:

a receiver body having an opening for receiving a part of the stationary hook;

a rocker arm having a first end and a second end, the first end being opposite the second end, the rocker arm being pivotably coupled at a location between the first end and the second end to a fixed point on the receiver body;

a hook roller carrier pivotably coupled to the first end of the rocker arm and moveable with the first end of the rocker arm;

a hook roller being mounted on the hook roller carrier and movable with the hook roller carrier, the hook roller configured to engage the part of the stationary hook to secure the side swing door in the closed position;

a spring/plunger mechanism having an upper end and a lower end, the upper end being pivotably coupled to the second end of the rocker arm and movable with the second end of the rocker arm, and the lower end being pivotably coupled to a fixed point on the receiver body;

a hook roller latch fixed to the receiver body, the hook roller latch being disposed adjacent to the opening in the receiver body, wherein the hook roller is configured to engage a surface of the hook roller latch when the hook roller is disengaged from the part of the stationary hook.

23. The home cooking appliance of claim 22, further comprising:

means for self-correcting for a sagging condition of the side swing door by lifting the side swing door in an upward vertical direction during movement of the side swing door from the open position to the closed position.

* * * * *